US010568813B2

(12) United States Patent
Jacobs et al.

(10) Patent No.: US 10,568,813 B2
(45) Date of Patent: Feb. 25, 2020

(54) PILL FEEDER

(71) Applicant: PerceptiMed, Inc., Mountain View, CA (US)

(72) Inventors: Alan Jacobs, Palo Alto, CA (US); Brandon Loeb, Campbell, CA (US); Robert Peikin, San Mateo, CA (US)

(73) Assignee: PerceptiMed, Inc., Mountain View, CA (US)

( * ) Notice: Subject to any disclaimer, the term of this patent is extended or adjusted under 35 U.S.C. 154(b) by 0 days.

(21) Appl. No.: 14/907,805

(22) PCT Filed: Aug. 8, 2014

(86) PCT No.: PCT/US2014/050443

§ 371 (c)(1),
(2) Date: Jan. 26, 2016

(87) PCT Pub. No.: WO2015/021445

PCT Pub. Date: Feb. 12, 2015

(65) Prior Publication Data

US 2016/0193113 A1 Jul. 7, 2016

Related U.S. Application Data

(60) Provisional application No. 61/864,468, filed on Aug. 9, 2013, provisional application No. 61/926,870, filed
(Continued)

(51) Int. Cl.
*A61J 7/00* (2006.01)
*B65D 83/04* (2006.01)

(52) U.S. Cl.
CPC ..... *A61J 7/0076* (2013.01); *B65D 83/04* (2013.01)

(58) Field of Classification Search
CPC ..... A61J 7/02; A61J 7/0076; A61J 7/0084; A61J 2200/70; A61J 2205/40;
(Continued)

(56) References Cited

U.S. PATENT DOCUMENTS 2,109,658 A * 3/1938 Zierick ..... G07D 3/06 453/10
2,137,501 A 11/1938 Myers et al.
(Continued)

FOREIGN PATENT DOCUMENTS

CN 1183715 A 6/1998
CN 101106967 A 1/2008
(Continued)

OTHER PUBLICATIONS

Australian First Examination Report, Australian Application No. 2014306323, dated Mar. 10, 2016, 2 pages.
(Continued)

*Primary Examiner* — Gene O Crawford
*Assistant Examiner* — Kelvin L Randall, Jr.
(74) *Attorney, Agent, or Firm* — Fenwick & West LLP

(57) ABSTRACT

A pill feeder accepts a quantity of pills and organizes the pills into a single file where each pill is output in a controlled orientation at a controlled rate. The apparatus includes a moving surface, such as a rotating disk, to receive and move pills past one or more gates that separate and orient groups of pills into a single file. The gates can start at a closed position and open until a pill has passed the gate. In one embodiment, a mixer counter-rotates relative to the rotating disk to prevent jams of the pills. The single file of pills is then guided out to an exit chute via an exit path. An alternative exit path provides an alternative route via which the pills exit the pill feeder. Multiple sensors can control the movement of the gates and the rate at which the pills exit the pill feeder.

30 Claims, 18 Drawing Sheets

Related U.S. Application Data on Jan. 13, 2014, provisional application No. 61/990,257, filed on May 8, 2014.

(58) Field of Classification Search

CPC ..... B65B 5/103; B65B 35/06; B65B 39/002; B65D 83/04; G07F 11/005; G07F 17/0092

See application file for complete search history.

(56) References Cited

U.S. PATENT DOCUMENTS

| | | | | | |
|---|---|---|---|---|---|
| 2,801,025 | A * | 7/1957 | Cookson | A61J 7/02 | 221/169 |
| 3,054,497 | A | 9/1962 | Davis et al. | | |
| 3,215,310 | A | 11/1965 | Hurst et al. | | |
| 3,722,740 | A * | 3/1973 | List | B65G 47/1428 | 221/169 |
| 3,746,211 | A * | 7/1973 | Burgess, Jr. | G06M 7/00 | 221/13 |
| 3,837,139 | A * | 9/1974 | Roseberg | B65B 57/20 | 221/7 |
| 3,960,293 | A | 6/1976 | Sweet, II et al. | | |
| 4,088,143 | A * | 5/1978 | Bezsilko | G07D 9/008 | 453/6 |
| 5,097,985 | A * | 3/1992 | Jones | A63B 47/002 | 124/48 |
| 5,259,302 | A * | 11/1993 | Chen | A47J 37/044 | 134/132 |
| 5,369,940 | A * | 12/1994 | Soloman | B65B 57/20 | 53/500 |
| 5,474,493 | A * | 12/1995 | Tolbert | B65G 47/1457 | 198/392 |
| 5,564,551 | A * | 10/1996 | Schmitt | B65B 35/10 | 198/390 |
| 6,053,302 | A | 4/2000 | Leu et al. | | |
| 6,080,057 | A * | 6/2000 | Bell | G07D 1/00 | 221/203 |
| 6,161,721 | A * | 12/2000 | Kudera | G07F 11/16 | 221/277 |
| 7,412,302 | B2 * | 8/2008 | Cobb | G07F 17/0092 | 700/231 |
| 7,549,266 | B2 | 6/2009 | Yuyama et al. | | |
| 7,861,846 | B1 * | 1/2011 | Salditch | B65G 47/1457 | 198/392 |
| 9,382,024 | B2 * | 7/2016 | Baroncini | B65B 35/28 | |
| 2003/0111484 | A1 | 6/2003 | Pearson et al. | | |
| 2004/0099683 | A1 * | 5/2004 | Shows | G06F 19/3462 | 221/263 |
| 2004/0118753 | A1 * | 6/2004 | Belway | A61J 7/02 | 209/551 |
| 2006/0006190 | A1 | 1/2006 | Janet et al. | | |
| 2009/0140002 | A1 * | 6/2009 | Farnsworth | B65B 39/001 | 221/178 |
| 2011/0042404 | A1 | 2/2011 | Koike et al. | | |
| 2011/0301747 | A1 * | 12/2011 | Chambers | B65G 47/1428 | 700/231 |
| 2013/0284755 | A1 | 10/2013 | Yuyama et al. | | |
| 2013/0292401 | A1 * | 11/2013 | Yuyama | A61J 7/02 | 221/7 |
| 2013/0334242 | A1 | 12/2013 | Yuyama et al. | | |
| 2016/0000655 | A1 * | 1/2016 | Yuyama | A61J 7/02 | 221/7 |

FOREIGN PATENT DOCUMENTS

| | | | | |
|---|---|---|---|---|
| CN | 102727534 | A | 10/2012 | |
| EP | 2676654 | A1 | 12/2013 | |
| EP | 2829480 | A4 * | 3/2016 | A61J 7/02 |
| JP | S 57-23516 | A | 2/1982 | |
| JP | S 60-17788 | U | 2/1985 | |
| JP | S 60-106711 | A | 6/1985 | |
| JP | H05-22416 | U | 3/1993 | |
| JP | H05-270651 | A | 10/1993 | |
| JP | 2003-95315 | A | 4/2003 | |
| JP | 4575749 | B1 | 11/2010 | |
| JP | 2011-097969 | A | 5/2011 | |
| JP | 2013-013777 | A | 1/2013 | |
| WO | WO 2012/099189 | A1 | 7/2012 | |

OTHER PUBLICATIONS

Canadian Office Action, Canadian Application No. 2,920,354, dated Jun. 2, 2016, 3 pages.

Japanese Office Action, Japanese Application No. 2016-522044, dated Jul. 19, 2016, 21 pages.

Patent Cooperation Treaty, International Search Report and Written Opinion of the International Searching Authority, International Patent Application No. PCT/US2014/050443, dated Dec. 16, 2014, 9 Pages.

European Extended Search Report, European Application No. 14835026.7, dated Feb. 28, 2017, 8 pages.

Canadian Office Action, Canadian Application No. 2,920,354, dated Sep. 30, 2016, 3 pages.

Chinese Office Action, Chinese Application No. 201480054876.2, dated Dec. 21, 2016, 6 pages (with concise explanation of relevance).

Chinese Third Office Action, Chinese Application No. 201480054876.2, dated Sep. 19, 2017, 4 pages (with concise explanation of relevance).

Chinese Second Office Action, Chinese Application No. 201480054876.2, dated Jun. 2, 2017, 13 pages.

* cited by examiner

PILL FEEDER

CROSS REFERENCE TO RELATED APPLICATIONS

This application claims the benefit of U.S. Provisional Application No. 61/864,468, filed Aug. 9, 2013, U.S. Provisional Application No. 61/926,870, filed Jan. 13, 2014, and U.S. Provisional Application No. 61/990,257, filed May 8, 2014, each of which is incorporated by reference in its entirety.

BACKGROUND

This invention generally relates to a pill feeding mechanism, and more particularly to orienting a group of pills, and controlling a flow rate of the group of pills exiting the pill feeding mechanism.

Pharmacies and chemists often dispense pills to customers or patients on receiving a prescription from the customer or patient. The pharmacist working at the pharmacy will often manually identify, verify and count pills based on the prescription received prior to providing the customer with the pills prescribed. Often, due to human error a pharmacist may miscount the number pills to provide to the customer resulting in the customer not receiving the prescribed number of pills. Further, the pharmacist may accidentally provide the customer with different pills than those prescribed to the customer, which places the customer in harm's way. To overcome these problems many automated methods have been developed to count and/or identify pills. However, in order to function efficiently and accurately, the automated methods often require, as an input, a controlled rate of flow of pills having a specific orientation. Thus, it is beneficial for accurate and efficient pill identification, verification, and counting that a system be developed to provide the automated systems with a controlled rate of flow of pills having a specific orientation.

SUMMARY

A pill feeder separates and orients a group of pills and controls a flow rate of the pills exiting the pill feeder. Some embodiments of the pill feeder include a rotating surface, such as a rotating disk that moves pills within the feeder and at least one gate that controls passage of pills to an exit path. The rotating disk receives pills and moves the pills through one or more gates that separate the pills into a single file line in a controlled orientation. For example, the pill feeder can include one or both of a lift gate and a separator gate. The lift gate rises to a height that allows a pill through the lift gate in a flat orientation and prevents pills stacking on top of one another. The rotating disk moves the pills to the lift gate and through the lift gate to orient the pills. The rotating disk next moves the pills to the separator gate that opens to allow a single-file line of pills through the separator gate. The line of pills is then guided out to an exit chute via an exit path. A mixer can be included in the center of the rotating disk that counter-rotates relative to the rotating disk to prevent jams of the pills in areas where the pills may become jammed between the center of the rotating disk and the outside wall, in particular between the lift gate and separator gate, or before the lift gate. The pill feeder provides a flow of single-file pills that can be used with various mechanisms, such as a pill verifying system. In one embodiment, an alternative exit path (e.g., alternative to the exit path of the exit chute) guides pills on the rotating disk to an alternative exit chute. An alternative exit path gate allows pills to enter, or prevents pills from entering, the alternate exit path. Pills that travel down the alternate exit chute collect in a funnel with a pivot gate. When a container is pressed against the pivot gate, the pills are released from the funnel into the container.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
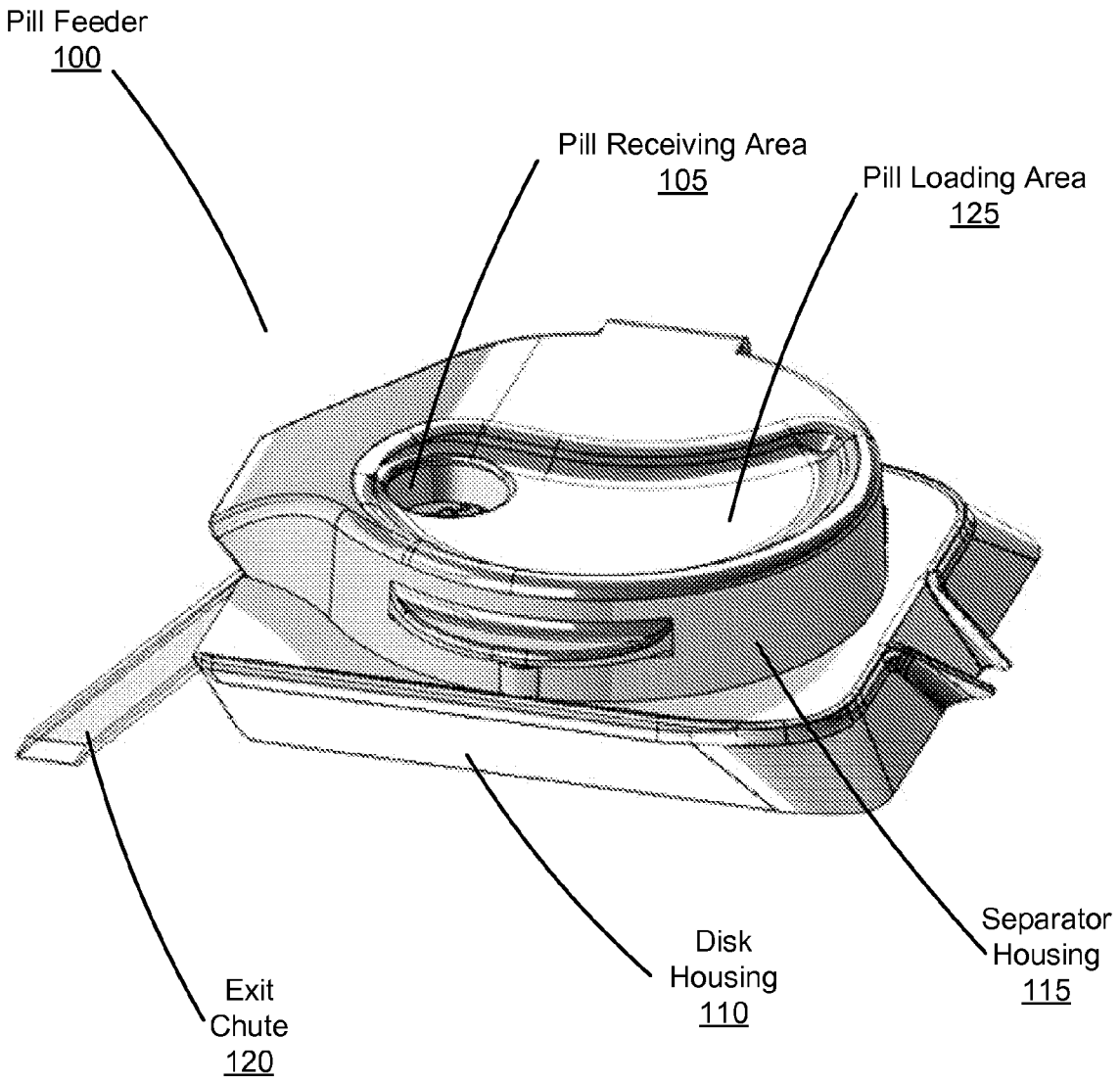
FIG. 1 is an external view of a pill feeder, according to one embodiment.

FIG. 1 is an external view of a pill feeder 100, according to one embodiment. The pill feeder 100 includes a pill loading area 125 for receiving pills from an operator, where the pills may further be moved by the operator from the pill loading area 125 to a pill receiving area 105. In one embodiment, the pill loading area 125 may contain a funnel or other shaped structure to hold or aide in moving the pills into the receiving area 105. The funnel receives a small or large number of pills simultaneously, and holds additional pills while the pill feeder processes pills that have already entered the pill receiving area 105. The pill feeder 100 receives pills in the pill receiving area 105 and uses mechanisms in a housing, such as disk housing 110 and a separator housing 115 to release pills, one by one, in a controlled orientation and at a controlled rate down an exit chute 120. Hence, the pill feeder 100 can be used to supply other mechanisms or objects that may perform functions on or hold pills. For example, the pill feeder 100 may be used in concurrence with a pill verifying machine to verify pills for a prescription, thereby reducing the time spent by a pharmacist counting or verifying pills. One example of a pill verifying machine is described in U.S. patent application Ser. No. 13/583,598, filed Sep. 7, 2012, which is hereby incorporated by reference in its entirety.

The pill feeder 100 can also be used to separate and orient groups of other types of objects that may be irregularly shaped, such as bolts, nuts or washers. Similar to receiving pills, the pill receiving area 105 receives a group of irregularly shaped objects. The mechanisms in the disk housing 110 and the separator housing 115 act on the irregularly shaped objects releasing the objects, one by one, in a controlled orientation and at a controlled rate.

The pill receiving area 105 receives pills from the pill loading area 125 and transfers the pills to the pill control mechanisms within the separator housing 115. The user primarily interacts with the pill feeder 100 through the pill receiving area 105. The pill feeder 100 may be used with pills of varying sizes, shapes, and textures, and may include capsules, tablets and other medication types, though generally similar pills are used with the pill feeder 100 at a single time. For example, a pill may be oblong in shape, purple in color and have a gelatinous coating or circular in shape, white in color and have a chalky texture. As examples, the pill feeder 100 may be used with a hundred large round pills or thirty small oblong pills to feed pills individually through the exit chute 120. The user places pills in the pill receiving area 105 from the pill loading area 125 individually or in groups.

Components of the disk housing 110 and separator housing 115 move pills from the pill receiving area 105 to the exit chute 120. In one embodiment, the disk housing 110 houses a moving surface, such as a disk, and a motor to rotate the disk that is used to move the pills throughout the housing. A disk or a generally circular-shaped surface is one example of a moving surface that can be used in the pill feeder. Other shapes are also possible for both the moving surface and the housing. In some embodiments, the moving surface has a conveyor belt design. The separator housing 115 includes components that control the orientation of the pills and separate pills from one another. A sensor controls the speed of the disk rotation such that pills exiting the chute 120 leave the pill feeder 100 at a controlled speed. Thus, pills placed in the pill receiving area 105 fall on the rotating disk and the rotating disk moves the pills to the exit chute 120. The exit chute 120 includes an entry area on one end for receiving a pill from the pill feeder 100 and at least one exit area at another end for providing the pill to a mechanism or object attached to the pill feeder 100. In addition to a controlled rate of exit, the entry area of exit chute 120 typically receives the pills at a controlled orientation, such as on a flat side of the pill.

Figure 2A:
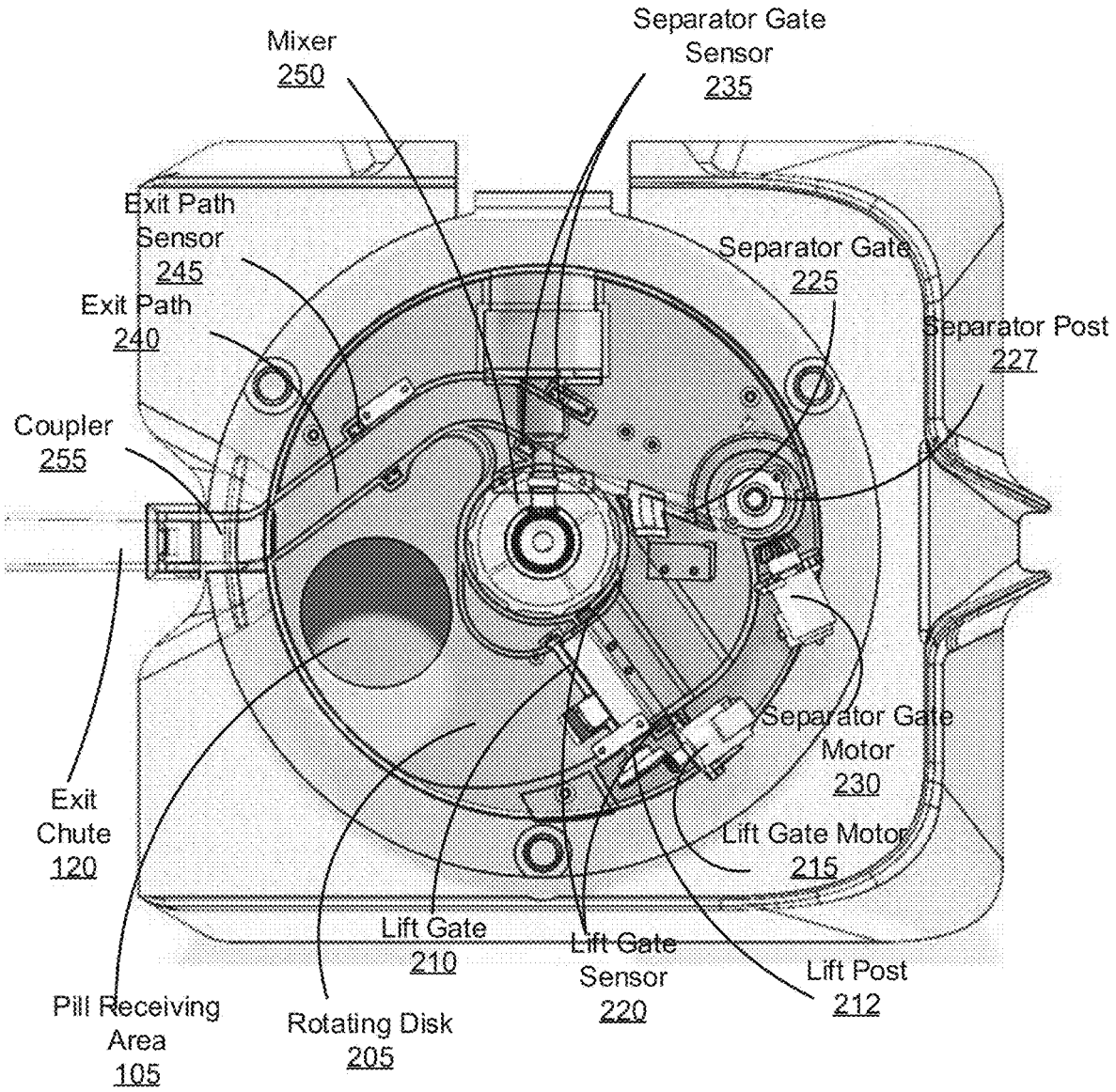
FIG. 2A is a top view of the internal mechanisms of a pill feeder.
Figure 2B:
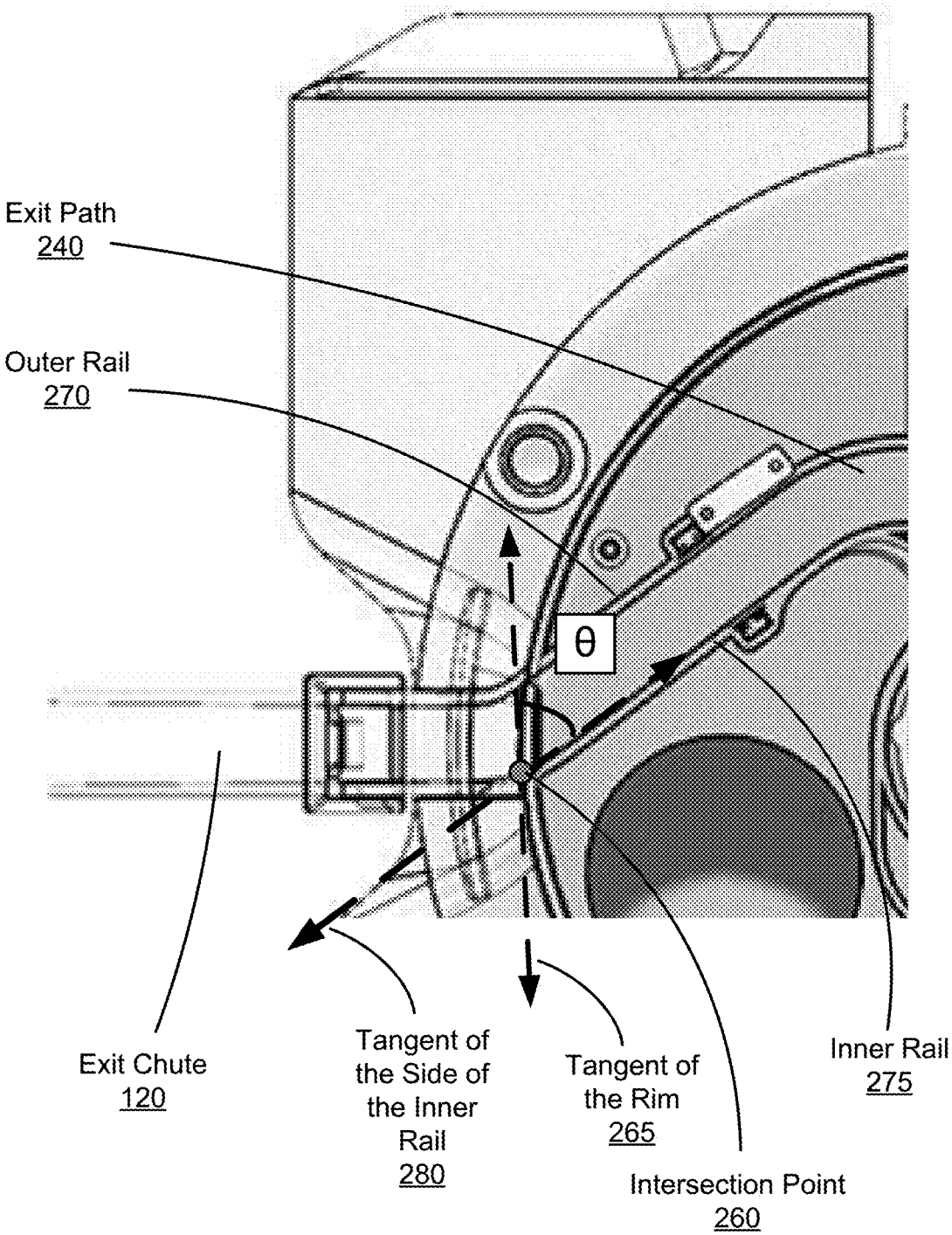
FIG. 2B is a zoomed-in view of an intersection point of an exit path, according to one embodiment.

FIG. 2 is a top view of the internal mechanisms of the pill feeder 100, and FIG. 2B is a zoomed-in view of an intersection point 260 of an exit path 240, according to one embodiment. The pills first make contact with a rotating disk 205 when they are placed in the receiving area 105. As the pills make contact with the rotating disk 205 they may rest in groups bunched together or spread out individually across the surface of the rotating disk, based on the number of pills that are placed in the receiving area 105. Furthermore, each pill's orientation may differ from that of the other pills in the group. For example, a circular or cylindrical pill may enter the receiving area 105 and rest on the rotating disk 205 on its side, permitting the pill to roll on the rotating disk 205. For the pills to exit the pill feeder 100 in a controlled orientation and at a controlled rate, the pills are oriented to lay flat on the rotating disk 205 and separated from one another (e.g., not stacked on top of one another or bunched together such that a portion of a pill is resting on another pill) by the pill feeder 100.

The rotating disk 205 is a circular platter rotating about a center spindle, and in this embodiment, generally moves the pills counterclockwise within the separator housing 115. The pills moving counterclockwise mean the pills generally move around from the pill receiving area 105, through a lift gate 210, which orients the pills, to a separator gate 225, which separates the pills, to an exit path 240 where the exit rate is controlled to the exit chute 120.

The rotating disk 205 is made of a material that provides sufficient friction to the pills to move the pills as the disk rotates. For example, the rotating disk 205 may be made of textured plastic with de-bossed patterns. As pills are manufactured with a variety of textures, some of which may be very smooth, the friction on the surface of the disk is sufficient to move these smooth pills. The surface of the rotating disk 205 is also ridged, scored, hatched, or otherwise textured in various embodiments to provide additional friction and to dislodge pills that may get jammed or stuck.

As the pills are moved by the rotating disk 205 from the pill receiving area 105, the pills come in contact with the lift gate 210. The lift gate 210 is located on the rotating disk 205 in the rotation direction of the rotating disk 205 relative to the receiving area 105 (e.g., downstream from the receiving area 105 in the direction of the movement of the disk 205). In one embodiment, the lift gate 210 is attached to a post or a lift post 212. In another embodiment the lift gate 210 pivots open along an axis horizontal and above the rotating disk 205. The post 212 is raised or lowered vertically, or pivoted, by a lift gate motor 215, thereby raising, lowering or rotating the lift gate 210. The lift gate 210 prevents the pills from stacking on top of each other as they pass through the lift gate 210 by providing vertical clearance only for the height of a single pill or for a height slightly greater than that of a single pill. The lift gate 210 also ensures that the pills that pass through the gate 210 rest on the same dimension or edge of the pill. Thus, the lift gate 210 organizes the pills by allowing only pills that are oriented in a particular way (e.g., on a side) to pass the lift gate 210. For example, both stacked and rolling pills may be prevented from passing the lift gate 210 by the position of the lift gate 210.

In one embodiment, the lift gate 210, in a closed position, initially rests close to the rotating disk 205. After the pill feeder initiates operation, the lift gate 210 is gradually raised. The lift gate 210 is raised to a height that allows for at least one pill, in an orientation, to pass through the gate 210. As the gate 210 rises, the pill profile that is lowest among the pill orientations passes under the lift gate 210. As described below, a lift gate sensor 220 detects when a pill passes the lift gate 210 and is used to determine when to stop raising the lift gate 210. By gradually rising, the lift gate 210 allows the pill feeder 100 to accommodate a variety of types of pills without using pill height or size information ahead of time to determine an appropriate height.

Figure 11:
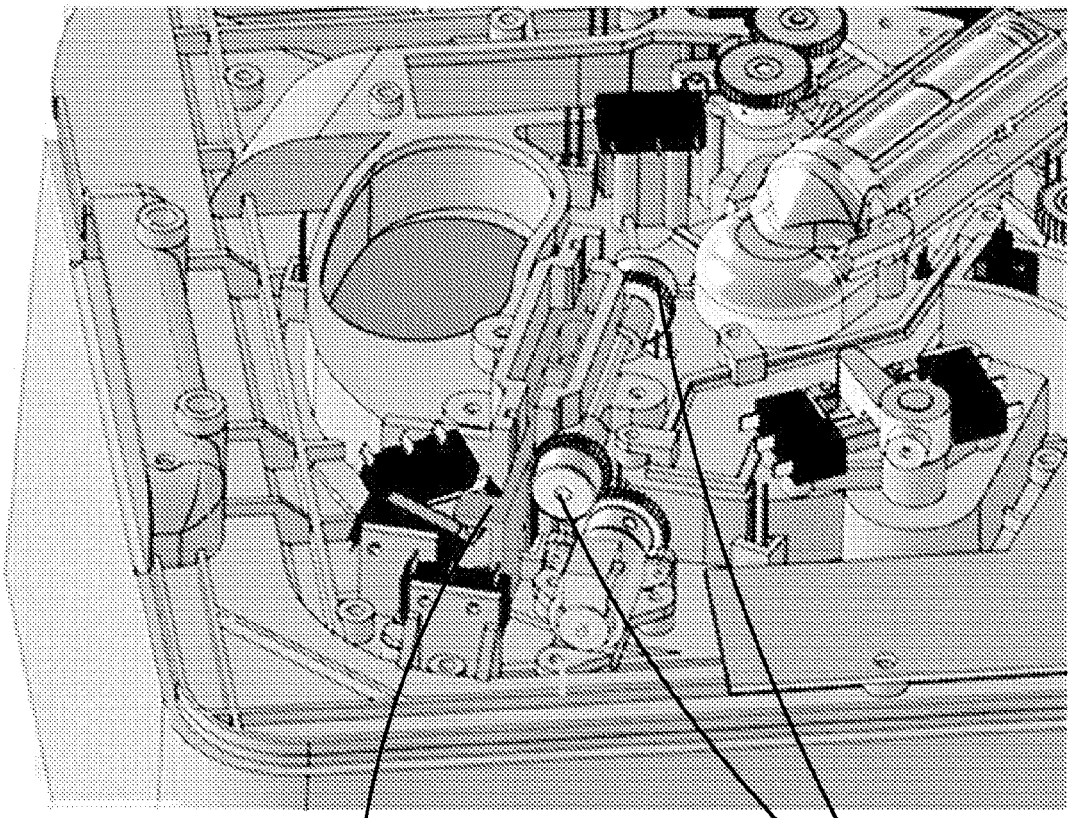
FIG. 11 shows a lift gate that opens vertically, according to one embodiment.
Figure 12:
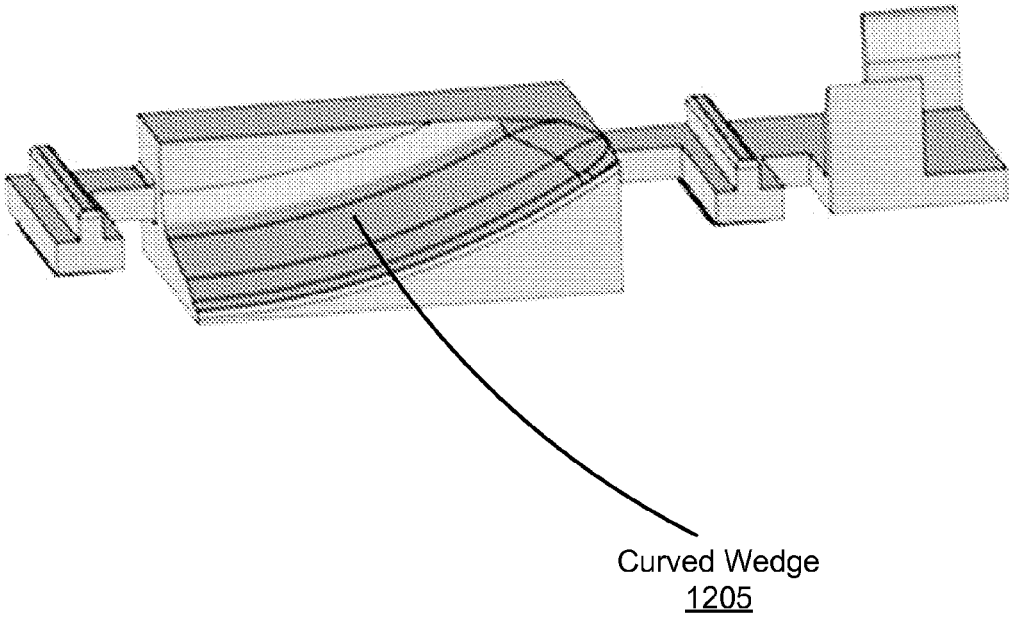
FIG. 12 shows a lift gate with a curved wedge on the front face of the gate, according to one embodiment.
Figure 13:
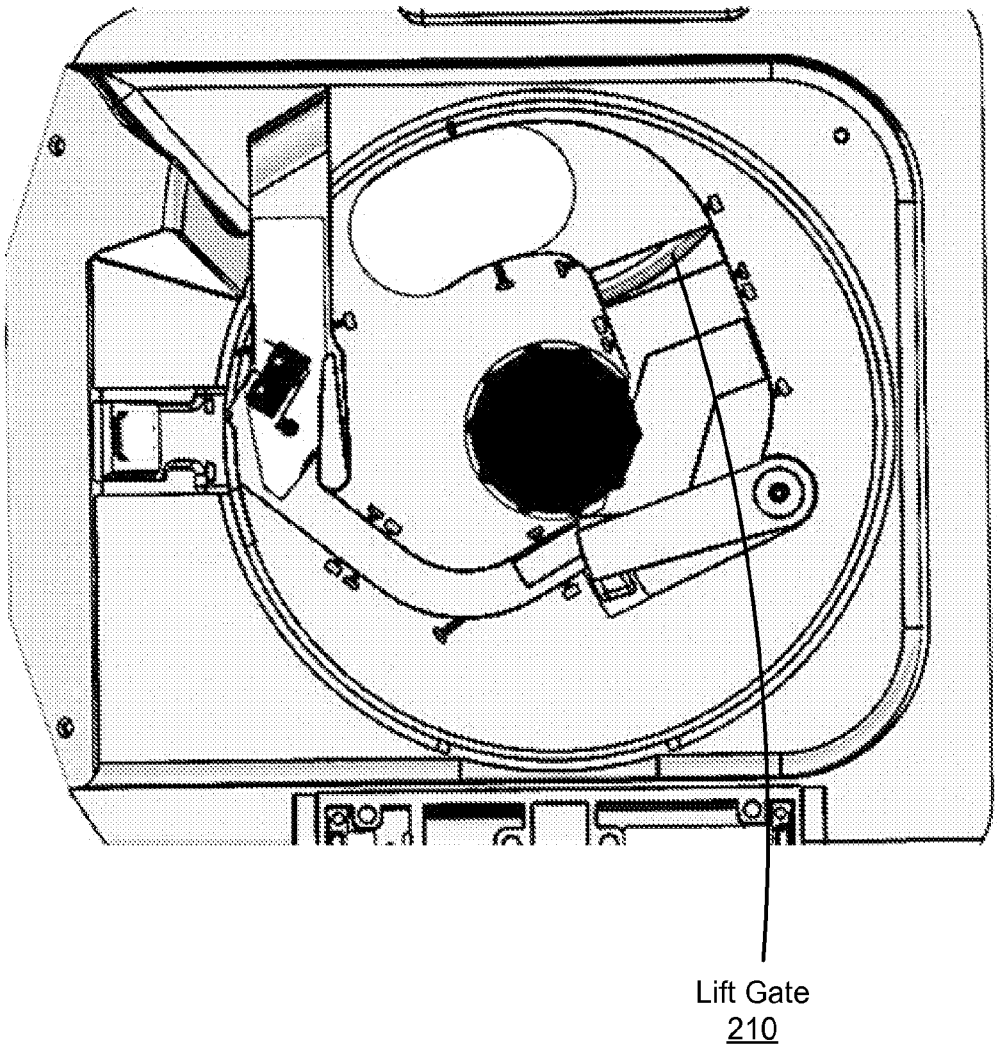
FIG. 13 shows a view of the lift gate from below the pill feeder, according to one embodiment.

In one embodiment, lift gate 210 opens vertically allowing for at least one pill, in an orientation, to pass through the gate 210, by sliding along a track using a gear rack and pinion 1105 as shown in FIG. 11. This enables a variety of geometries to be used across the face of the gate 210, and reduces the chances that pills will wedge under the lift gate 210. In one example, the lift gate 210 has a geometry of a curved wedge 1205 on the front face as shown in FIG. 12. The curved wedge 1205 on the front face of the lift gate 210 destabilizes pills from stacking against the front face and allows pills to slide and unjam themselves as they are moved towards the lift gate 210 by the rotating disk 205. FIG. 13 is a view from below of the pill feeder 110 and the lift gate 210 with the curved wedge 1205. Having the lift gate 210 open vertically by sliding along a track using a gear rack and pinion 1105, as shown in FIG. 11, allows for changes to the gate geometry and may simplify the lift gate 210 mechanism.

Returning now to the description of FIG. 2A, after the pill passes through the lift gate 210, a lift gate sensor 220 detects the passage of the pill. The lift gate sensor 220 in this embodiment is a light-based detector that is occluded when a pill passes between an emitter and detector pair. In other embodiments, other sensor types are used to determine when a pill passes the lift gate 210. After the sensor 220 detects a pill, the gate sensor 220 stops the raising of the gate 210, such that only other pills in the orientation of the pill that was sensed, or another orientation with a similar profile may pass under the lift gate 210. In other embodiments the lift gate 210 is raised an additional amount from the level at which a pill was sensed by the gate sensor 220. For example, the lift gate 210 is raised an additional 10%, 25%, or 50% higher in various configurations. In one embodiment, the height is raised an additional absolute amount, such as 10 or 20 millimeters, rather than a percentage of the current height. This additional gate height allows pills that are oriented on another side of the pill (but not stacked on one another, rolling, or otherwise not oriented on a side) to pass through the lift gate 210. In one embodiment, rather than raising upwards, the lift gate 210 rotates on a hinge in the direction of rotation of the rotating disk 205. The rotation of the lift gate 210 opens an area under the lift gate 210 as the lift gate 210 rotates upwards from the rotating disk 205.

Figure 3:
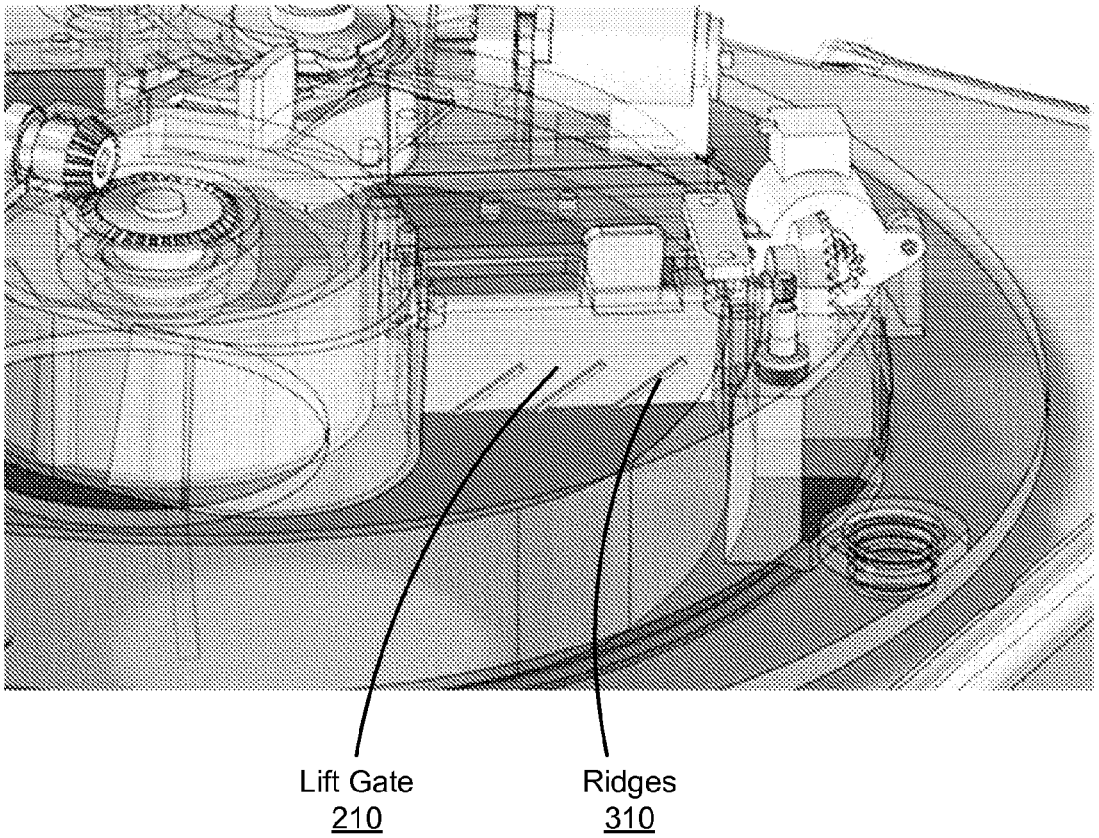
FIG. 3 shows a lift gate, according to one embodiment.

FIG. 3 shows the rotating disk 205 and the lift gate 210 according to one embodiment. In one embodiment, the lift gate 210 is positioned at an angle with respect to the direction of movement of the pills along the rotating disk 205. That is, the angle of the lift gate 210 is not perpendicular to the rotating disk 205. Thus, pills make contact with the lift gate 210 at an angle. The angle of the gate 210 assists in orienting pills as well as creates room for the movement of pills away from the gate 210 thereby preventing jams at the opening of the lift gate 210. As pills make contact with the angled front of the lift gate 210, the pills may turn along the surface of the lift gate 210, thereby changing orientation, for example by tipping rolling pills. Furthermore, as pills are moved against the surface of the lift gate 210, the angled position of the gate 210 allows pills that do not pass through the lift gate 210 to move along the surface of the gate 210 away from the center of the gate 210. The angled gate 210 also assists in knocking down rolling pills. In other embodiments, the angle of the lift gate 210 with respect to the direction of movement of the pills may be changed before, after or during the movement of pills through the lift gate 210.

In one embodiment, the lift gate 210 has ridges 310 extending outward from the face of the lift gate 210. In an alternative embodiment, other textures or surfaces may be used on the face of the lift gate 210 or depressions made in the face of lift gate 210. For example, the lift gate may be textured with bumps, curved ridges, divots, or other features. These textures (e.g., ridges 310) help re-orient pills that roll against the lift gate 210 when the rolling pills come in contact with the face of the lift gate 210. In one embodiment, parts or the whole of the surface of the lift gate 210 are be textured.

In one embodiment, the rotating disk 205 has ridges either rising from the surface of the rotating disk 205 or embedded in the surface of the rotating disk 205 (not shown). The ridges are angled in any suitable direction, such as diagonally across the surface of the rotating disk 205 or radially outward from the center of the rotating disk 205. The ridges may assist in the orientation of pills and disrupt pills that are rolling on the rotating disk 205. As the rotating disk 205 turns, the ridges contact the pills, including when the pills interact with other objects such as the lift gate 205 or separator gate 225. Hence, the pills are turned or disrupted at the gates when impacted by the ridges on the rotating disk 205. In other embodiments, depressions or other structures present on the rotating disk 205 are used to assist in the orientation of the pills.

Referring again to FIG. 2A, a separator gate 225 separates the pills prior to the pills entering the exit path 240. The separator gate is located on the rotating disk in the rotation direction of the rotating disk relative to the receiving area (e.g., it is downstream from the receiving area in the direction of movement of the disk). The separator gate 225 opens from a closed position and ensures that pills enter the exit path 240 in a single file and in a controlled orientation. In one embodiment the separator gate 220 is attached to a post 227. The post 227 is rotated about its center by a separator gate motor 230, thereby rotating the separator gate 225 open and closed. The separator gate 225 is opened far enough that a single pill may pass at a time between a mixer 250 and separator gate 225. The separator gate 225 also ensures that the pills that pass through the gate 225 are generally oriented in a similar direction. Thus, the separator gate 225 organizes the pills into a single file with each pill being similarly oriented, by allowing only a single pill to pass through the separator gate 225 and orienting the pill as it pass through the separator gate 225. For example, a single oblong shaped pill can be oriented with its longer edge parallel to the direction of movement of the pill on the rotating disk 205.

Figure 4:
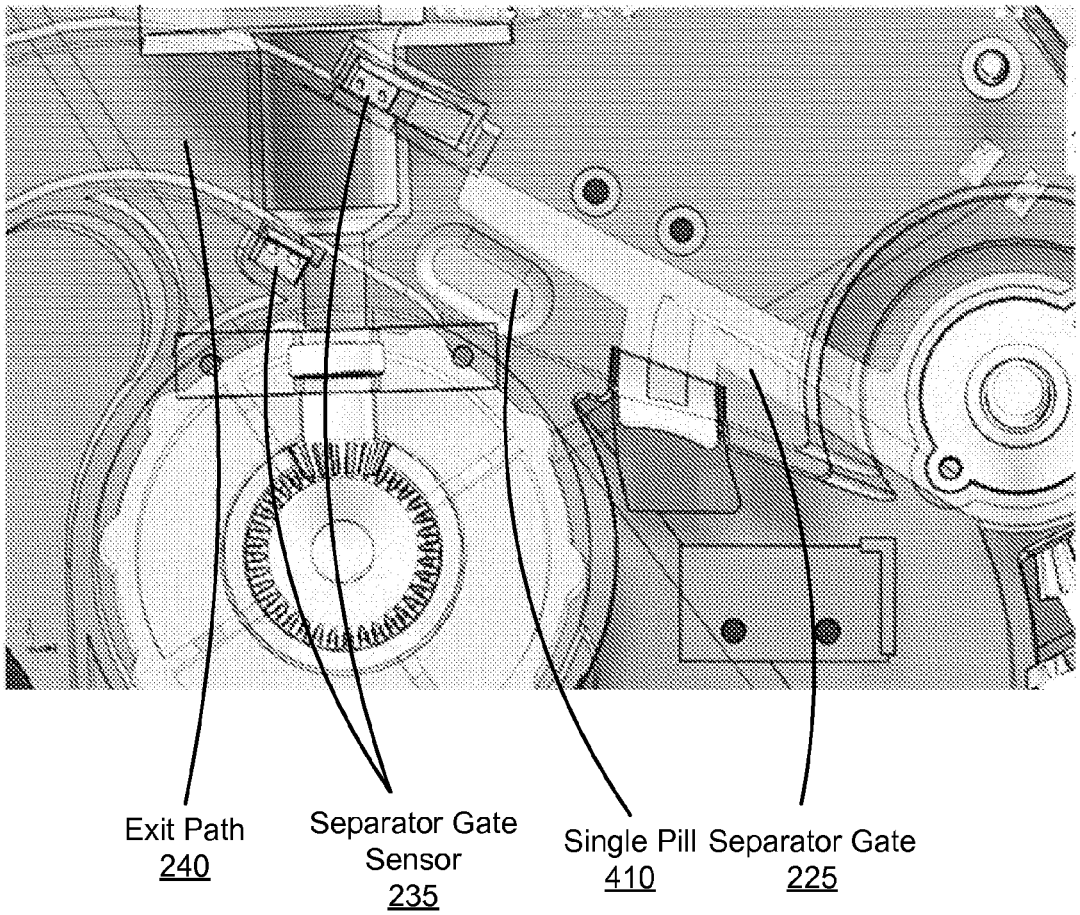
FIG. 4 is a top view of a separator gate in a pill feeder, according to one embodiment.

In one embodiment, the separator gate 225 initially rests close to the surface of the rotating disk 205 and the mixer 250 in the closed position. The separator gate 225 is rotated away from the mixer 250 to open the separator gate 225 to a position that allows for one pill, in an orientation, to pass through the gate 225. FIG. 4 illustrates the separator gate 225 opened to a position that allows a single pill 410 to pass through the separator gate 225 according to one embodiment. After the pill passes through the gate 225, a separator gate sensor 235 detects the passage of the pill. The separator gate sensor 235 in this embodiment is a light-based detector that is occluded when a pill passes between an emitter and detector pair. In other embodiments, other sensing methods are used to determine when a pill passes separator gate 225. After the separator gate sensor 235 detects a pill, the separator gate motor 225 is stopped, such that only a single pill at a time may pass the separator gate 225. In other embodiments the separator gate 225 is opened to a distance greater than the distance when a pill was identified by the separator gate sensor 235, such as 10%, 25%, or 50% farther. In one embodiment the distance is increased an additional absolute amount, such as 10 mm, rather than a percentage of the current distance. This helps ensure that pills that are oriented on another side of the pill may pass through separator gate 225 one at a time.

In one embodiment, the separator gate 225 is positioned at an angle with respect to the direction of movement of the pills along the rotating disk 205. Thus, pills make contact with the separator gate 225 at an angle. The angle of the gate assists in orienting pills thereby preventing jams at the opening of the gate 225. As pills make contact with the angled gate 225, the pills turn along the surface of the angled gate 225. Furthermore, as pills are moved against the surface of the separator gate 225, the angled position of the separator gate 225 causes the pills that don't pass through the separator gate 225 to move along the surface of the gate towards the mixer 250. As described further below, the mixer 250 counter-rotates relative to the direction of movement of the rotating disk 205. When a pill contacts the mixer 250, the mixer 250 moves the pill backwards relative to the direction of rotation of the rotating disk 205, which reorients the pill and frees up the opening of the separator gate 225 for other pills to pass between the separator gate 225 and mixer 250. In other embodiments, the angle of the separator gate 225 with respect to the direction of movement of the pills may be changed before, after or during the movement of pills through the gate 225.

Figure 14:
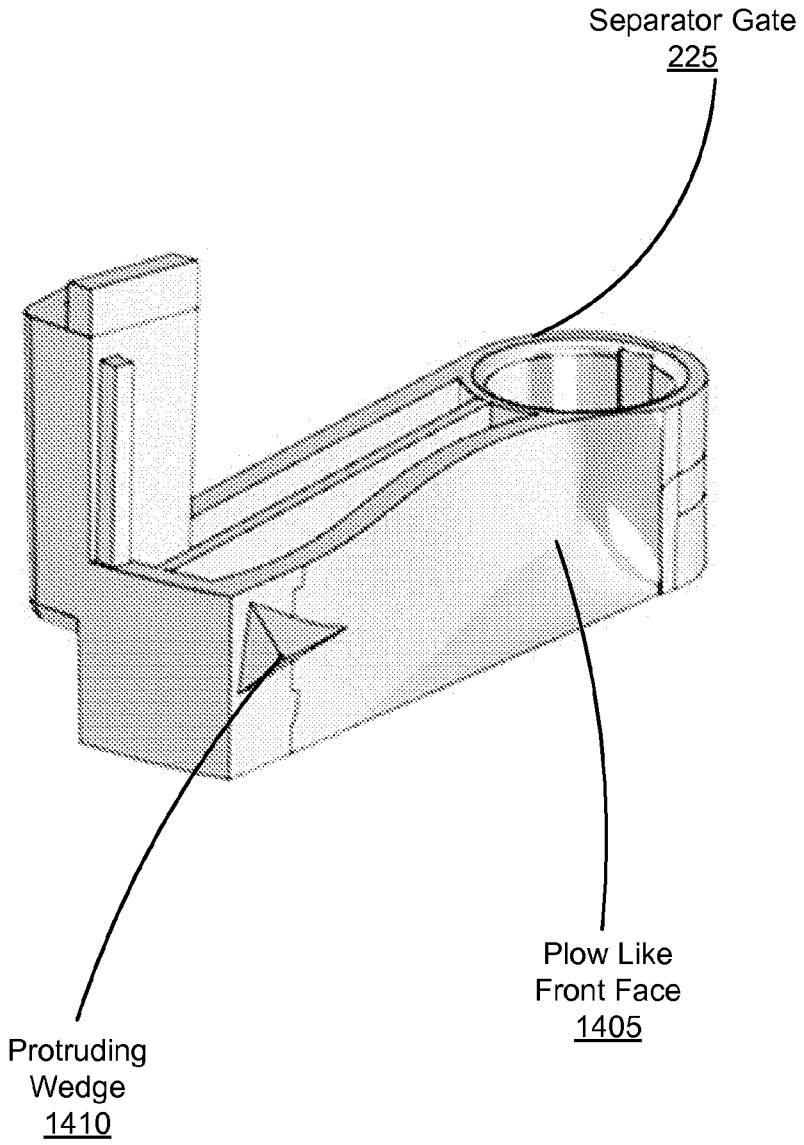
FIG. 14 shows a separator gate with a plow like front face and a protruding wedge, according to one embodiment.
Figure 15:
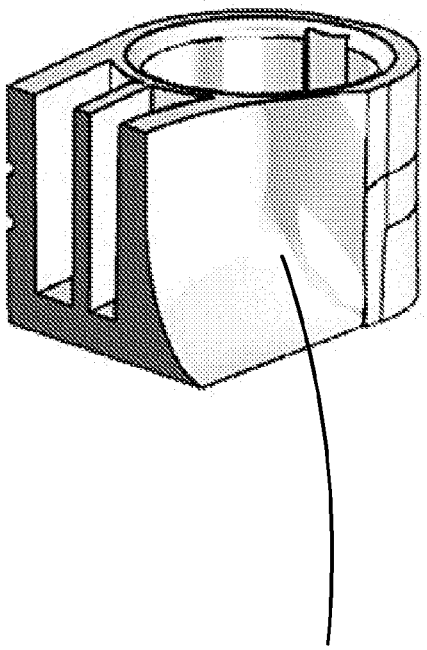
FIG. 15 shows a portion of a separator gate including a plow like front face, according to one embodiment.
Figure 16:
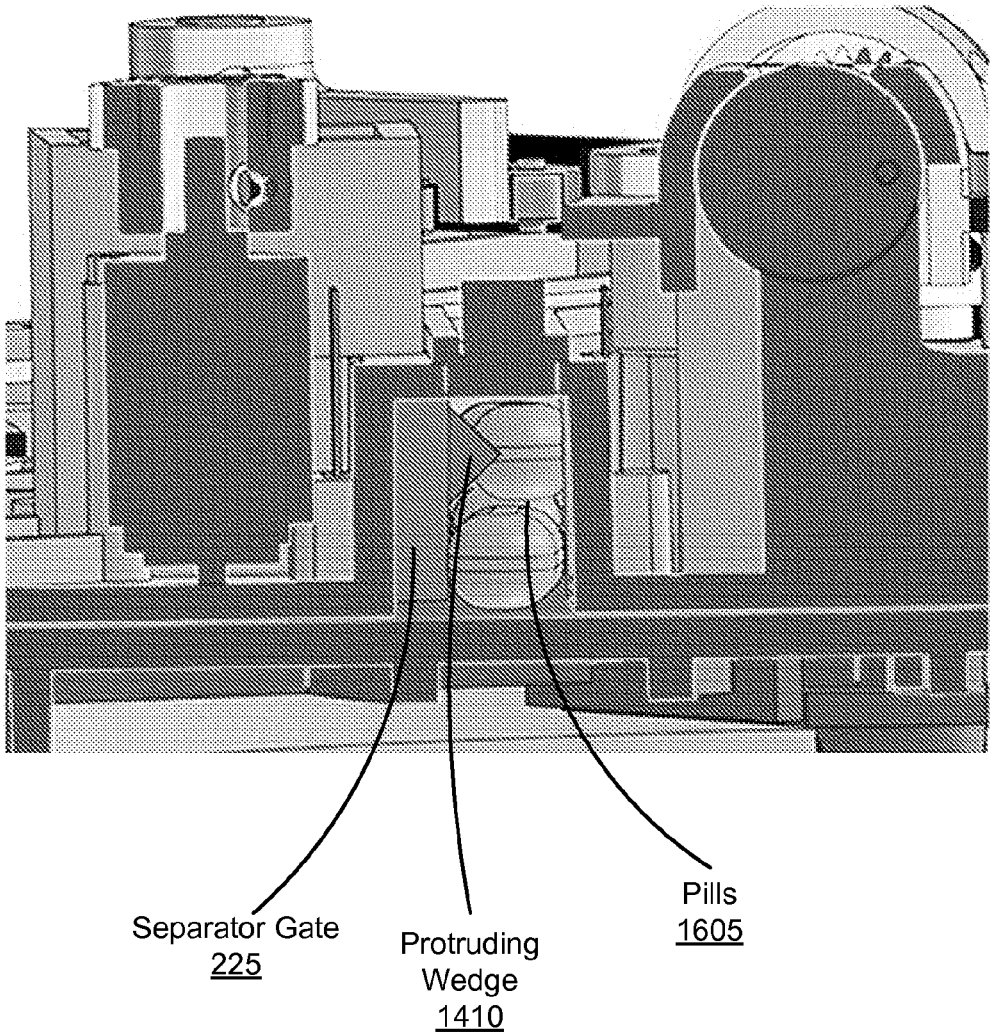
FIG. 16 shows a protruding wedge of a separator gate interacting with pill, according to one embodiment.

The separator gate 225 in varying embodiments may have a variety of geometries specifying the shape of the front face of the gate. In one embodiment, the separator gate 225 has a plow like front face 1405 curving into the face of the separator gate 225 as shown in FIG. 14. This configuration assists in preventing large pills from piling up and jamming at the face of the gate 225. The plow like front face 1405 of the separator gate 225 helps longer pills lift themselves up and around each other pushing them towards the mixer 250, to make the turn towards the mixer 250. In another embodiment, the separator gate 225 has a protruding wedge 1410 extending from the tip of the gate 225, as shown in FIG. 14. Though the lift gate 210 generally prevents pills from stacking, the protruding wedge 1410 at the separator gate 225 may also prevent pills from stacking on one another and prevent two pills passing through the separator gate 225 simultaneously. The separator gate 225 may have a combination of the protruding wedge and the 'plow like' front face. The protruding wedge 1410 and plow like front face 1405 both individually and in combination assist throughput by causing the pills to travel single file through to the exit path 240. FIG. 15 shows the portion of the separator gate 225 including the plow like front face 1405. FIG. 16 shows the protruding wedge 1410 of the separator gate 225 interacting with pills 1605, disrupting pills 1605 stacked on top of other pills 1605.

Referring again to FIG. 2A, the mixer 250 interacts with pills on the rotating disk 205 in the area between the lift gate 210 and the separator gate 225. The mixer 250 is comprised of a cylindrical drum with circular protrusions or knobs on the surface and a motor to drive the cylindrical drum. In one embodiment, the mixer 250 rotates in the direction opposite (counter-rotates) to the rotation of the rotating disk 205. In another embodiment, the mixer 205 periodically alternates direction (counter-clockwise, clockwise, counter-clockwise, etc.) to the direction of rotation of the rotating disk 205. The alternating direction of the mixer 250 may aide in dislodging jammed pills at the openings of the gates or on the rotating disk 205. The mixer 250 prevents pills from bunching up together, rolling or jamming the flow of pills through the separator gate 225. When a pill contacts the mixer 250, the pill contacting the mixer 250 is pushed backwards relative to the flow of pills that do not contact the mixer 250. Thus, pills contacting the mixer 250 are reshuffled to other parts of the rotating disk 205, thereby preventing jams. In one embodiment, the mixer 250 prevents jams at both the lift gate 210 and separator gate 225.

In one embodiment, the knobs on the mixer 250 are spaced apart and smoothly extend from the mixer 250, rising gradually from the exterior of the mixer 250. The shape and spacing of the knobs on the mixer 250 may prevent pills from being pressed between the mixer 250 and any adjacent structure in the pill feeder 100. If a pill is between a knob and an adjacent structure, the curvature of the knob pushes the pill gently outward from the center of the mixer 250, reducing the likelihood of the pill becoming trapped. The spacing of the knobs ensure that there is variation in the mixing process, and that there is room for pills caught by the mixer 250 to move backwards without disrupting the flow of the pills in the center of the rotating disk 205. In one embodiment the knobs are evenly spaced around the circumference of the mixer. In another embodiment the knobs are asymmetrically spaced around the circumference of the mixer. The knobs in one embodiment are substantially smooth so as to prevent the pinching of pills as they come in contact with the mixer 250.

Figure 17:
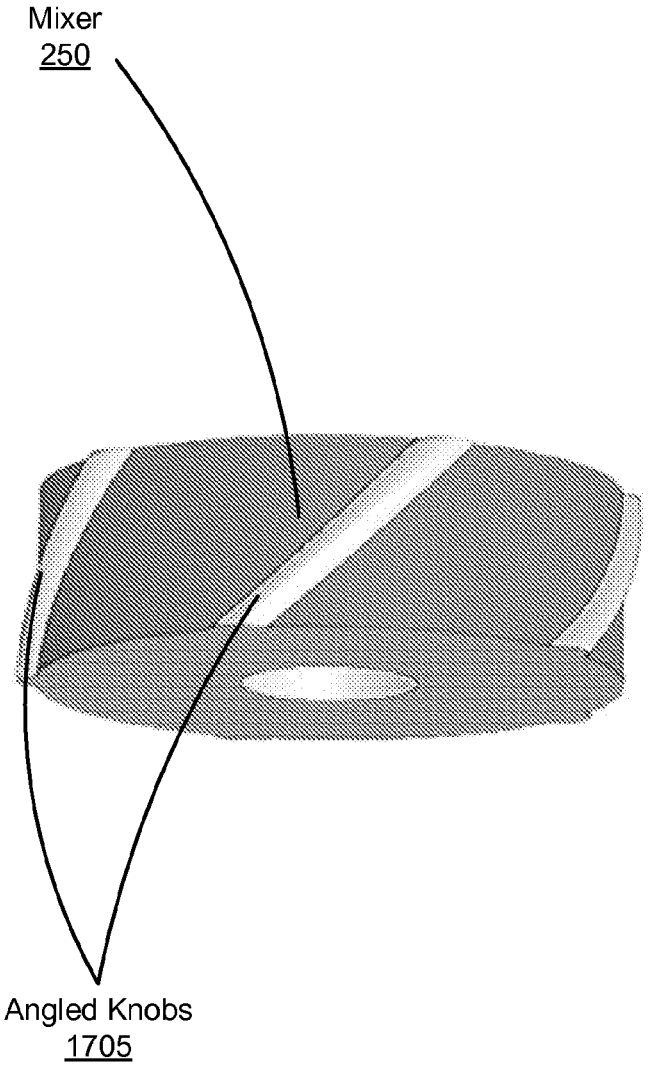
FIG. 17 shows a mixer with angled knobs, according to one embodiment.

In one embodiment, the knobs on the mixer 250 are in a threaded pitch design extending from the bottom face of the mixer 250 in an angle as shown in FIG. 17. The angled knobs 1705 help agitate the pills as they are pushed against the mixer 250 and separator gate 225. The pills that come in contact with the angled knobs are moved back and lifted over other pills coming in contact with the mixer 250 or on the rotating disk 205, thereby increasing throughput by preventing the pills from jamming at separator gate 225 or at the mixer 250. In one example, the angled knobs 1705 extend from the bottom edge of the mixer 250 at an angle within the range of 30 to 65 degrees and extend around the face of the mixer 250 ending at the top edge of the mixer 250. The number of angled knobs 1705 may vary, for example between 5 and 10 knobs across the face of the mixer 250. In one embodiment the mixer 250 is fastened to a rotating mechanism from above thereby leaving the bottom face of the mixer clean with no screws.

Returning to the discussion of the mixer 250 with respect to FIG. 2A, in one embodiment, the mixer 250 rotates at the same speed as that of the rotating disk 205. In other embodiments, the speed of the mixer 250 is regulated to develop pill-specific mixing conditions. As pills have different shapes and sizes, certain counter rotation speeds of the mixer 250 relative to the rotation speed of the rotating disk 205 results in the better mixing of pills of a certain shape, size and texture and fewer jams. For example, due to the difference in shapes between a circular pill and an oblong pill the rate of counter-rotation of the mixer 250 may be set differently to ensure fewer jams in the openings of the gates. In one embodiment the mixer 250 has a ridge running horizontally along the surface of the drum, either rising outward from the surface of the mixer 250 or going into the surface of the mixer 250. The ridge helps prevent the pills from rolling against the mixer 250, when the pills come in contact with the surface of the mixer 250, or disrupts pills that are already rolling.

In one embodiment, sensors are configured to detect a pill jam, occurring for example at the lift gate 210 or the separator gate 225. The sensors configured to detect a pill jam include the lift gate sensor 220, separator gate sensor 230, and additional sensors positioned ahead of the lift gate 210 or separator gate 225 (not shown). In various embodiments, other permutations and combinations of sensors is configured to detect a pill jam, for example in one embodiment, only the sensors positioned ahead of the lift gate 210 and separator gate 225 are used to detect jams. These sensors detect a pill by determining that the sensor senses a pill for a prolonged period of time at a location. When the sensors detect a jam, the pill feeder 100 reverses the direction of rotation of the rotating disk 205 or reverses the direction of rotation of the mixer 250. In various configurations, one or both of these is reversed. After a period of time, the rotation of direction is returned to the previous direction to continue pill feeding. While the direction is reversed, the rotating disk 205 may rotate in the same direction as the mixer 250.

The exit path 240 guides the pills from the separator gate 225 to the exit chute 120. In one embodiment the exit path 240 is a pair of guide rails attached to the separator housing 115. When the separator housing 115 is closed on the disk housing 110, the pair of guide rails is located just above a portion of the rotating disk 205. In one embodiment the exit path 240 is positioned to substantially orient the exit path 240, such that the exit path gradually moves across the rotating disk 105 from the separator gate 225 to the exit chute 120, approaching the exit chute 120 at an angle. The angle of the exit path 240 as it moves across the rotating disk 205 enables the pill to move from the separator gate 225 to the exit chute 120 despite the centripetal force experienced by the pill. The shape and positioning of the exit path 240, ensures that a pill leaving the separator gate 225 can exit the pill feeder 100 at a controlled rate, while maintaining a controlled orientation.

In one embodiment, pills exit the separator gate 225 and make contact with the rails of the exit path 240. The pills experience a centripetal force due to the rotating disk 205 along an arc of the radius of the rotating disk. When the pills enter the exit path 240, the centripetal force moves the pills towards the outer rail 270. The outer rail 270 of the exit path 240 guides the pill outward from the center of the rotating disk 205 back towards the exit chute 120 as it is being pushed outwards. As the pill enters the middle section of the exit path 240, the centripetal force moves the pill towards the inner rail 275 of the exit path 240. The inner rail 275 continues to guide the pill towards the exit chute 120, while maintaining the orientation of the pill. The angle of the inner rail 275, when interacting with the pill, causes a component of force to direct the pill outward from the center of the rotating disk 105.

In one embodiment the exit path 240 consists of a pair of rails that are initially curved as they leave the separator gate 225 and gradually straighten out as they approach the periphery of the rotating disk 205. Given the centripetal force experienced by the pill, the shape and positioning of the exit path 240 ensures that the pill enters the exit chute 120 at a controlled rate and in a controlled orientation. The initial radius of curvature of the curved portion of the exit path 240 ensures that pills being pushed outwards are guided without pause or interruption towards the periphery of the rotating disk 205. The radius of curvature of the exit path 240 is large enough to accommodate pills of different sizes and shapes. Without the radius of curvature, pills entering the exit path 240 would be forced vertically outward against the exit rails and may not experience an outward component of force significant enough to move the pills away from the center of the rotating disk, resulting in pills coming to a stop against the rails of the exit path 240.

The position of the end of the exit path 240 on the periphery of the rotating disk influences the orientation of the pill as it exits the pill feeder 100. In the embodiment of FIG. 2B, the exit path 240 approaches an intersection point 260 at or near the periphery of the rotating disk 205 at an exit path angle θ. The intersection point 260 is located at a side of the inner rail 275 between the inner rail 275 and outer rail 270. The exit path angle is defined as an angle measured between a tangent of the periphery of the rim 265 of the rotating disk 205 at the intersection point 260 and a tangent of the side of the inner rail 280 at the intersection point 260. In one embodiment, the exit path angle θ at the intersection point 260 is greater than 45 degrees to prevent pills from changing orientation (e.g., tumbling, rolling, etc) as the pills exit the exit path 240 and enter the exit chute 120. In other embodiments the exit path angle θ may range from 45 degrees to 75 degrees or 50 degrees to 80 degrees. At a desirable exit path angle θ, as a pill exits the exit path 120, the portion of the pill closer to the outer rail 270 as well as the portion of the pill closer to the inner rail 275 both exit the surface of the rotating disk 205 at a same time, preventing the pill from tumbling. If the exit path angle is not within a suitable range, the portion of the pill closer to the outer rail 270 will exit the surface of the rotating disk 205 before the portion of the pill closer to the inner rail 275 of the exit path 240, which causes the pill to tumble on entry to the exit chute 120. In this embodiment the exit path angle θ is less than 90 degrees, to allow for the pill to maintain a radially outward component of motion (influenced by the guide rail contacting the pill) large enough for the pill to exit the surface of the rotating disk 205.

Referring again to FIG. 2A an exit path sensor 245 monitors the rate at which pills flow through the exit path 240. The exit path sensor 245 in this embodiment is a light-based detector that is occluded when a pill passes between an emitter and detector pair. In other embodiments, other sensing methods are used to determine when a pill passes gate 210. The sensor 245 determines the time distance between the leading edge and the trailing edge of each pill as they pass through the exit path 240, by recording the amount of time the sensor 245 is occluded. Based on the time distance the sensor determines the rate at which each pill enters and exits the exit path 240. This rate represents the rate at which pills leave the pill feeder 100. In one embodiment the sensor 245 regulates the speed of rotation of the rotating disk 205 based on the rate of pills exiting the pill feeder 100, as determined by the sensor 245. The speed of the rotating disk can be controlled to reduce the rate of pills exiting the pill feeder 100 below a maximum.

In one embodiment, a coupler 255 positioned between the exit path 240 and the exit chute 120 couples the exit chute 120 to the exit path 240. The coupler 255 provides a smooth transition between the exit path 240 and the exit chute 120, such that pills exiting the exit path 240 may be directed to the exit chute 120 without changing orientation. In one example, the coupler 255 gradually extends from the periphery of the portion of the rotating disk 205 including the exit path 240 and couples with the exit chute 120. As shown, the coupler 255 does not rotate with the rotating disk 205 and in one embodiment the coupler 255 is attached to separator housing 115.

In some embodiments, a controller (not shown) receives sensor inputs from the various sensors and controls operation of the rotating disk 205, lift gate 210, separator gate 225, mixer 250, and additional mechanical components as described throughout. The controller in varying embodiments is implemented as a processer executing instructions on a memory, a hardware circuit, or a combination thereof Thus, the controller operates the lift gate motor 215 to raise the lift gate 210, controls rotation of the rotating disk 205, and so forth. The controller may receive indications from the lift gate sensor 220, separator gate sensor 235, and exit path sensor 245 to identify and monitor the location of pills within the pill feeder and use the sensor indications as described herein. Thus, the controller identifies when to stop raising the lift gate 210 based on the lift gate sensor 220, adjust the speed of rotation of the rotating disk based on rate of pills detected by the exit path sensor 245, and detect pill jams based on sensor information. Jams may be detected based on occlusion of various sensors or a failure of the exit path sensor to detect pills in the exit path when other sensors are occluded.

In certain embodiments, the controller may also receive an identification of a pill type for the pills to be input to the pill receiving area 105. The controller in one embodiment accesses a look-up table or database to retrieve settings to operate the pill feeder based on the pill type. The settings may include a height at which to set the lift gate or a width to set the separator gate. These lift gate and separator gate settings are used to set the height of the lift and separator gate in an embodiment. In addition, the settings may specify a rate at which to turn the rotating disk 205 and a rate and direction to turn the mixer 250. The settings may also indicate behaviors to clear jams for the particular pill type, such as parameters and/or patterns for changing the rotation of the rotating disk 205 or the mixer 250.

Figure 5A:
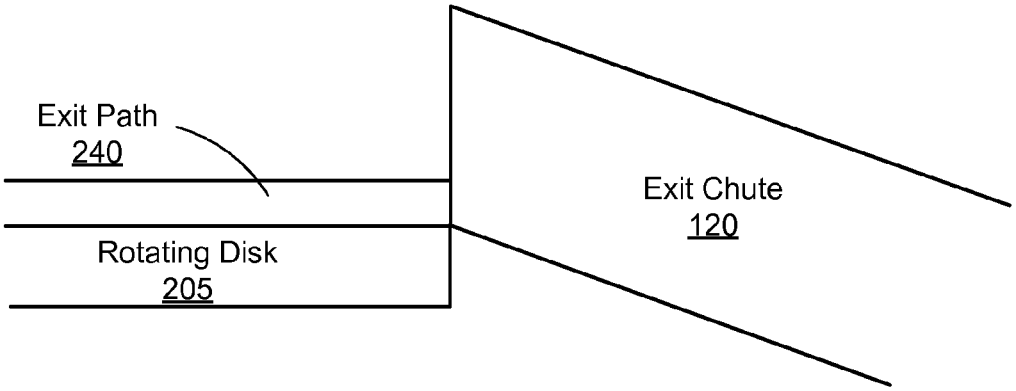
FIGS. 5A and 5B show side views of various embodiments of a transition from the rotating disk to an exit chute.
Figure 5B:
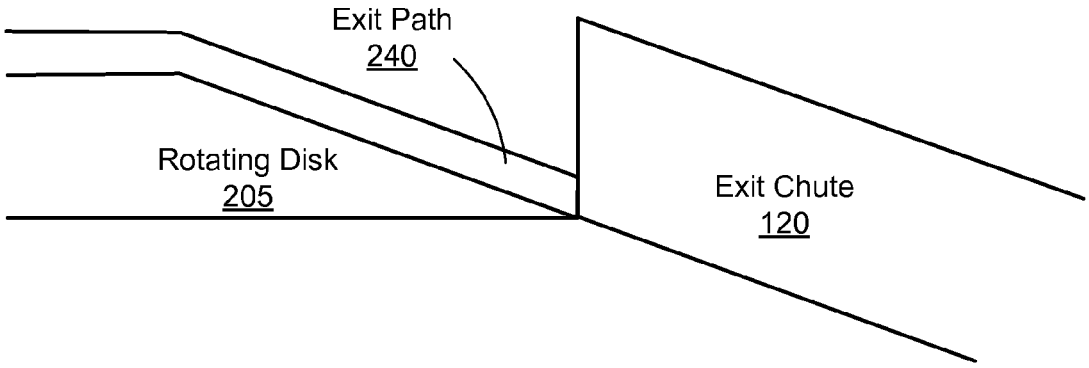

FIGS. 5A & 5B show a side view of the rotating disk 205 and the exit chute 120 according to various embodiments. As the pills leave the rotating disk 205 via the exit path 240, they come in contact with the exit chute 120. Other components that attach to the exit chute 120, such as a pill imaging or verification system, may rely on a relatively consistent orientation of the pills in the exit chute. Thus the interface between the pill feeder 100 and the exit path 240 reduces the likelihood that the pills change orientation on entering the exit chute 120. In one embodiment, the rotating disk 205 ends abruptly and perpendicular to the opening of the exit chute 120 as illustrated in FIG. 5A. The pills are guided to the exit chute 120 by the exit path 240. In this embodiment the bottom edge of the exit chute 120 is aligned with the surface of the rotating disk 205. In another embodiment, the edge of the rotating disk 205 tapers as it approaches the exit chute 120 as illustrated in FIG. 5B. In this embodiment the bottom edge of the exit chute 120 is aligned with the surface of the rotating disk 205. The tapering edge is beneficial in that it prevents pills from rolling or changing orientation as they enter the exit chute 120. In addition, the tapering edge provides an additional component of force outward from the center of the rotating disk 205 and assists the pills in sliding off the rotating disk 205. In various embodiments, the exit chute 120 is coupled to the rotating disk 105 at an angle of between 5 and 45 degrees to reduce the likelihood that the pills change orientation on entering the exit chute.

Figure 5C:
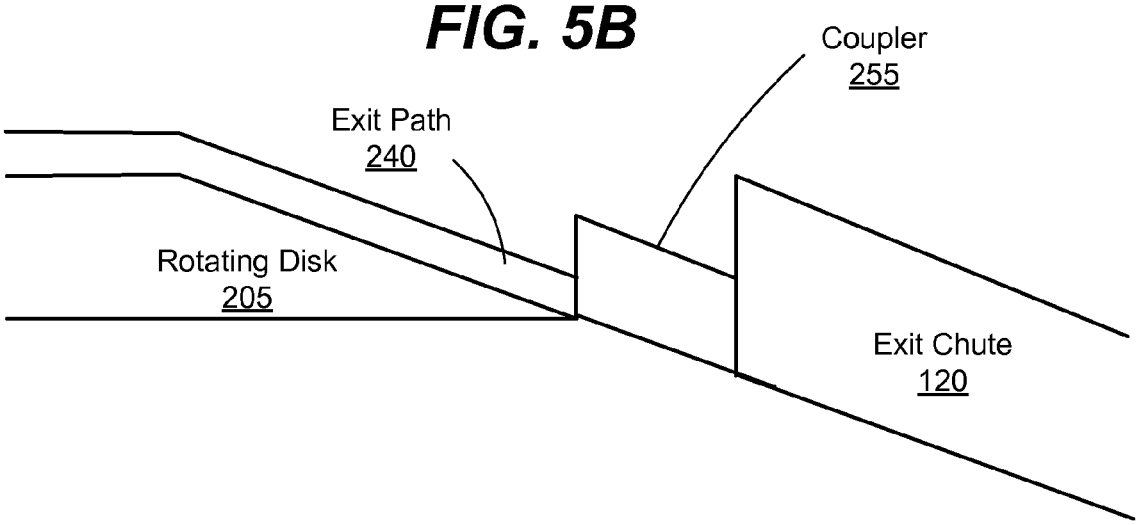
FIG. 5C shows a side view of a rotating disk, a coupler, and an exit chute, according to one embodiment.

FIG. 5C shows a side view of the rotating disk 205, the coupler 255, and the exit chute 120, according to one embodiment. As the pills leave the rotating disk 205 via the exit path 240, they come in contact with the coupler 255. The coupler 255 helps move pills exiting the exit path 240 to the exit chute 120 without altering the orientation of the pills. In the example of FIG. 5C the coupler 255 interfaces with the bottom edge of the tapering exit path 240, and maintains a gradual incline similar to that of the tapered portion of the exit path 240, before interfacing with the exit chute 120. The gradual incline of the coupler 255 is beneficial in that it prevents pills from rolling or changing orientation as they exit the exit path 240, travel through the coupler 255 and enter the exit chute 120.

Figure 6:
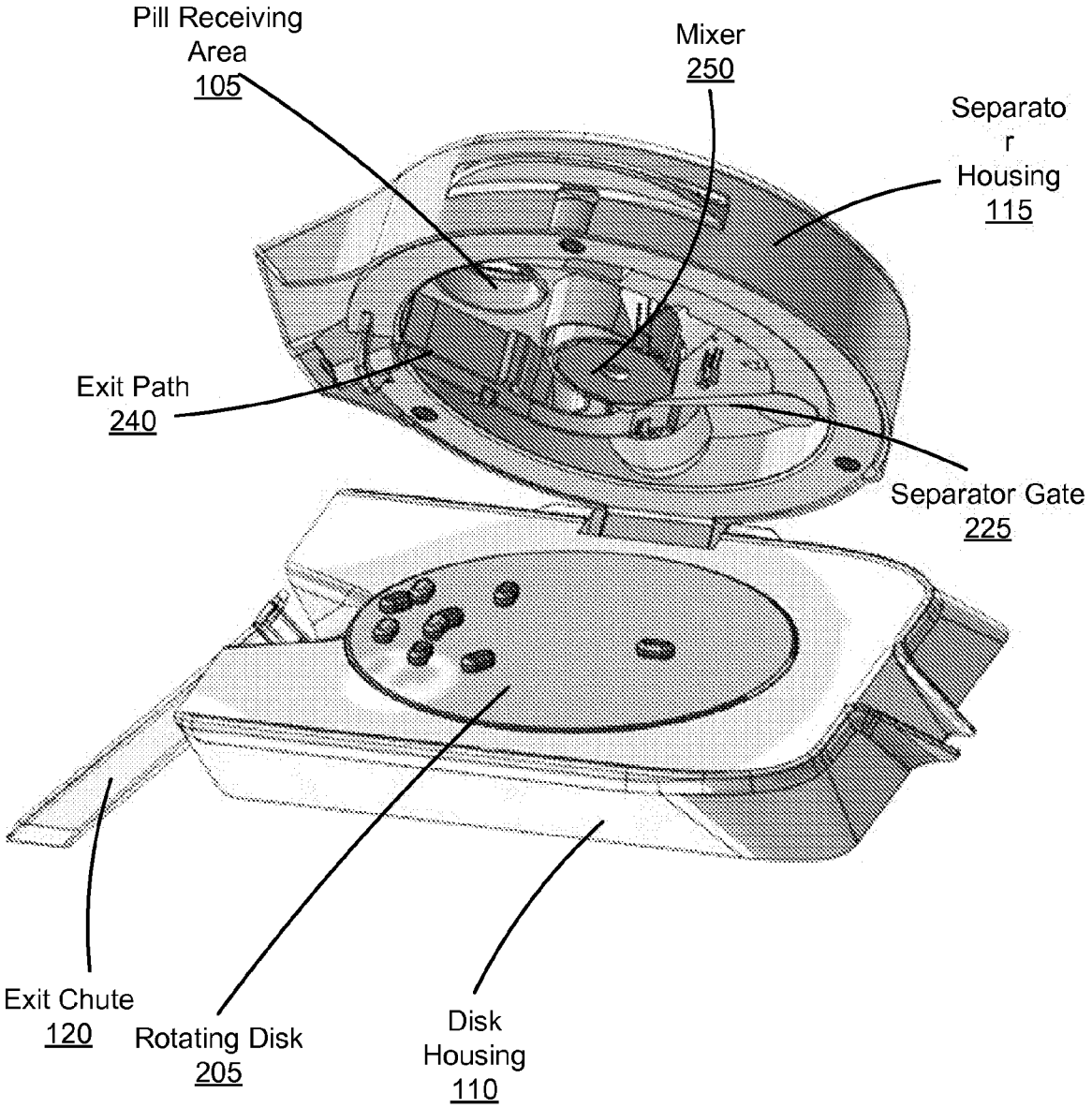
FIG. 6 shows a separator housing attached to a disk housing via a hinge system, according to one embodiment.

FIG. 6 shows the separator housing 115 attached to the disk housing 110 via a hinge system, according to one embodiment. In this embodiment the separator housing 115 can be lifted off of the disk housing 110 about a hinging mechanism. In this embodiment the inner mechanisms of the separator housing 115 can be repaired, cleaned or maintained by lifting the separator housing 115 off of the disk housing 110. Similarly excess pills or debris present on the rotating disk 205 can also be removed when required. In other embodiments, the separator housing 115 can be detached from the disk housing 110 using a number of other mechanisms or techniques.

Figure 7:
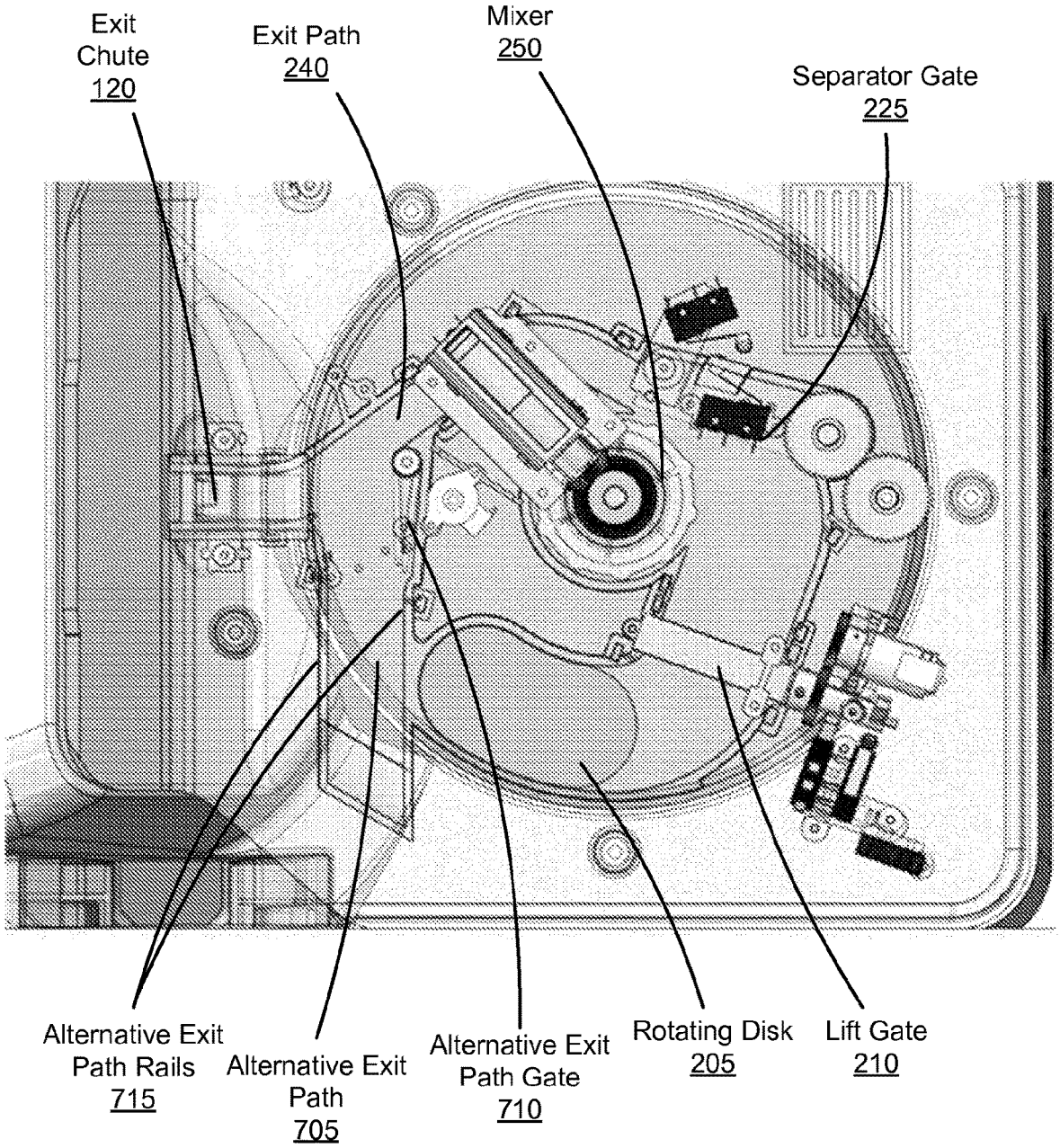
FIG. 7 shows an alternative exit path for removing extra pills present on the pill feeder, according to one embodiment.

FIG. 7 shows an alternative exit path 705 for pills that can be used for removing extra pills present on the pill feeder, according to one embodiment. In many cases, the number of pills permitted to enter the exit chute 120 should be limited. For example, the pill feeder may be configured to dispense a certain number of pills in order to fill a prescription, such as 30 pills. After dispensing the desired number of pills, remaining pills may be on the rotating disk 205, and may be in the exit path 240. In this embodiment the pills leave the rotating disk 205 via an alternative exit path 705 to automatically remove excess pills from the pill feeder without sending the pills to exit chute 120. Thus, the alternative exit path 705 provides a different exit route for pills to exit the pill feeder 100.

In one embodiment, an alternative exit path gate 710 opens or closes at the opening of the alternative exit path 705. The alternative path gate 710 controls entry to the alternative exit path 705 and allows pills to enter the alternative exit path 705 or prevents pills from entering the alternative exit path 705. In one embodiment, when in a closed position, the alternative exit path gate 710 is the guide rail of the exit path 240 nearer the center of the rotating disk 205. In this way, when the alternative exit path gate 710 is closed, the pills are directed by the alternative exit path gate 710 towards the exit chute 120 as described above. When the alternative exit path gate 710 is opened, the pills continue to travel the direction of the rotating disk towards the alternative exit path 705. In one example, a motor controls the opening and closing of the alternative exit path gate 710. In one example, the operator of the pill feeder 100 determines when to open and close the alternative exit path gate 710. Alternatively, the pill feeder 100 automatically opens or closes the alternative exit path gate 710 when an identified condition is satisfied, such as when a threshold number of pills have entered the exit chute 120.

In one embodiment, the alternative exit path 705 includes a pair of alternative exit path rails 715 that guide the pills from the alternative exit path gate 710 to the periphery of the rotating disk 205 similar to the guide rails described above with respect to the exit path 240. In one embodiment, the alternative exit path rails 715 are initially curved and straighten out as they approach the periphery of the rotating disk 205. As the pills interact with the alternative exit path rails 715 the initial curvature of the alternative exit path rails 175 allow the alternative exit path rails 715 to gradually change the direction of motion of the pills on the rotating disk 205. The alternative exit path 705 can be shorter or longer as desired, and can be shaped or can include projections, ridges, etc. to help effectively move pills along the path and avoid having pills get caught along the path.

Figure 8:
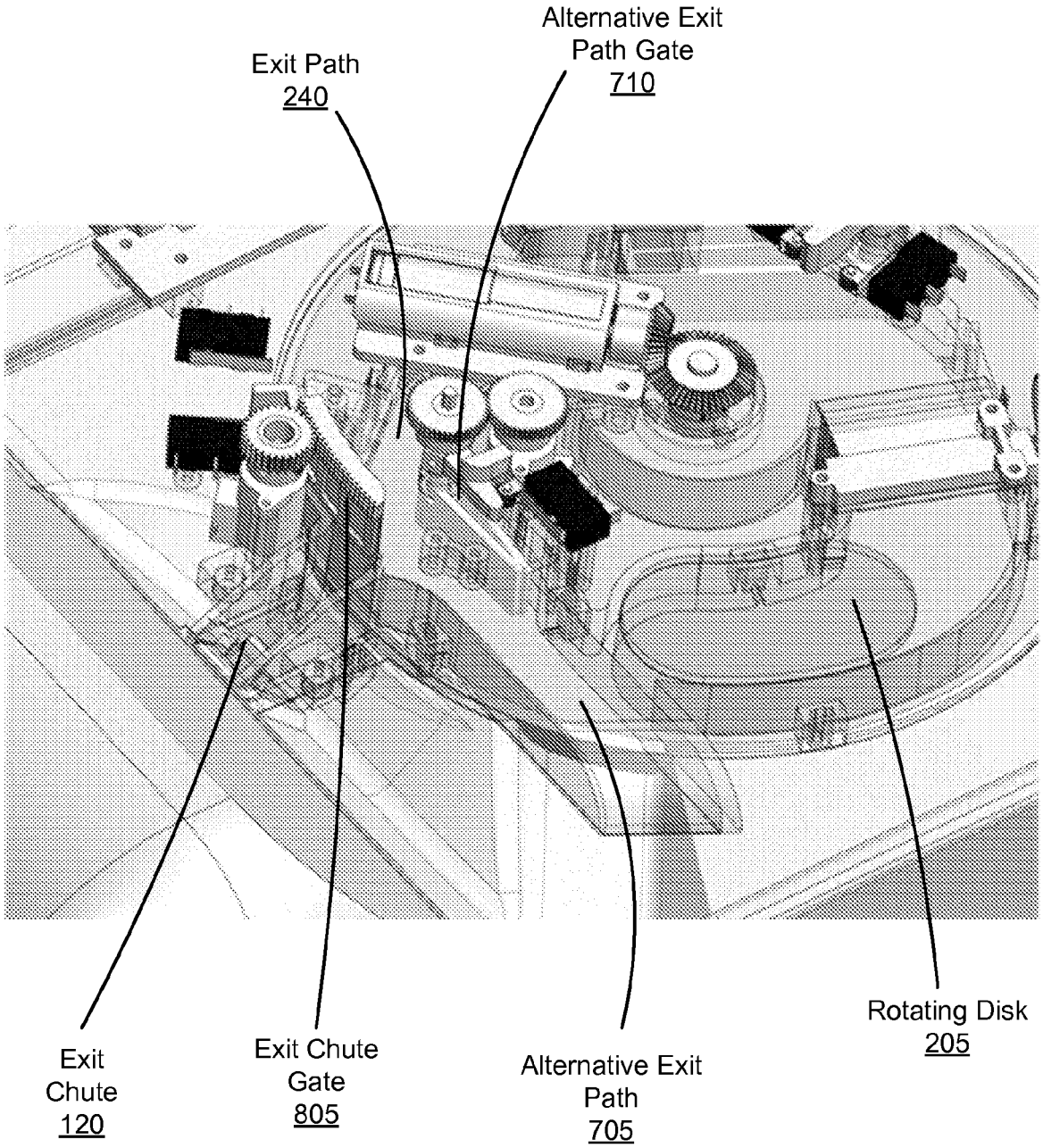
FIG. 8 shows an exit chute gate that prevents pills from entering the exit chute, according to one embodiment.

FIG. 8 shows an embodiment including an exit chute gate that prevents pills from entering the exit chute. In this embodiment, an exit chute gate 805 blocks the entry to the exit chute 120 when closed, thereby preventing pills from entering the exit chute 120. The open and closed position of the exit chute gate 805 may be controlled by a motor. In one example, the exit chute gate 805 has a gradual curve consistent with the curvature of the rotating disk 205. The curved shape of the exit chute gate 805 guides the pills on the rotating disk 205 through the alternative exit path 705. In one embodiment, the exit chute gate 805 is a flap that covers the opening of the exit chute 120. In another embodiment, the exit chute gate 805 is a bar that at least partially covers the opening to the exit chute 120. Thus, the exit chute gate 805 may be any mechanism for preventing pills from entering the exit chute 120.

In one embodiment, the position of the exit chute gate 805 is linked to the position of the alternative exit path gate 710. For example, when the alternative exit path gate 710 is in the open position, the exit chute gate 805 is in the closed position blocking off the opening to the exit chute 120. Similarly, when the alternative exit path gate 710 is in the closed position, the exit chute gate 805 is in the open position, allowing pills to enter the exit chute 120 via the exit path 240. The exit chute gate 805 may have a textured surface, smooth surface or a layered surface to aid in the guiding of the pills through the alternative exit path 705.

Figure 9:
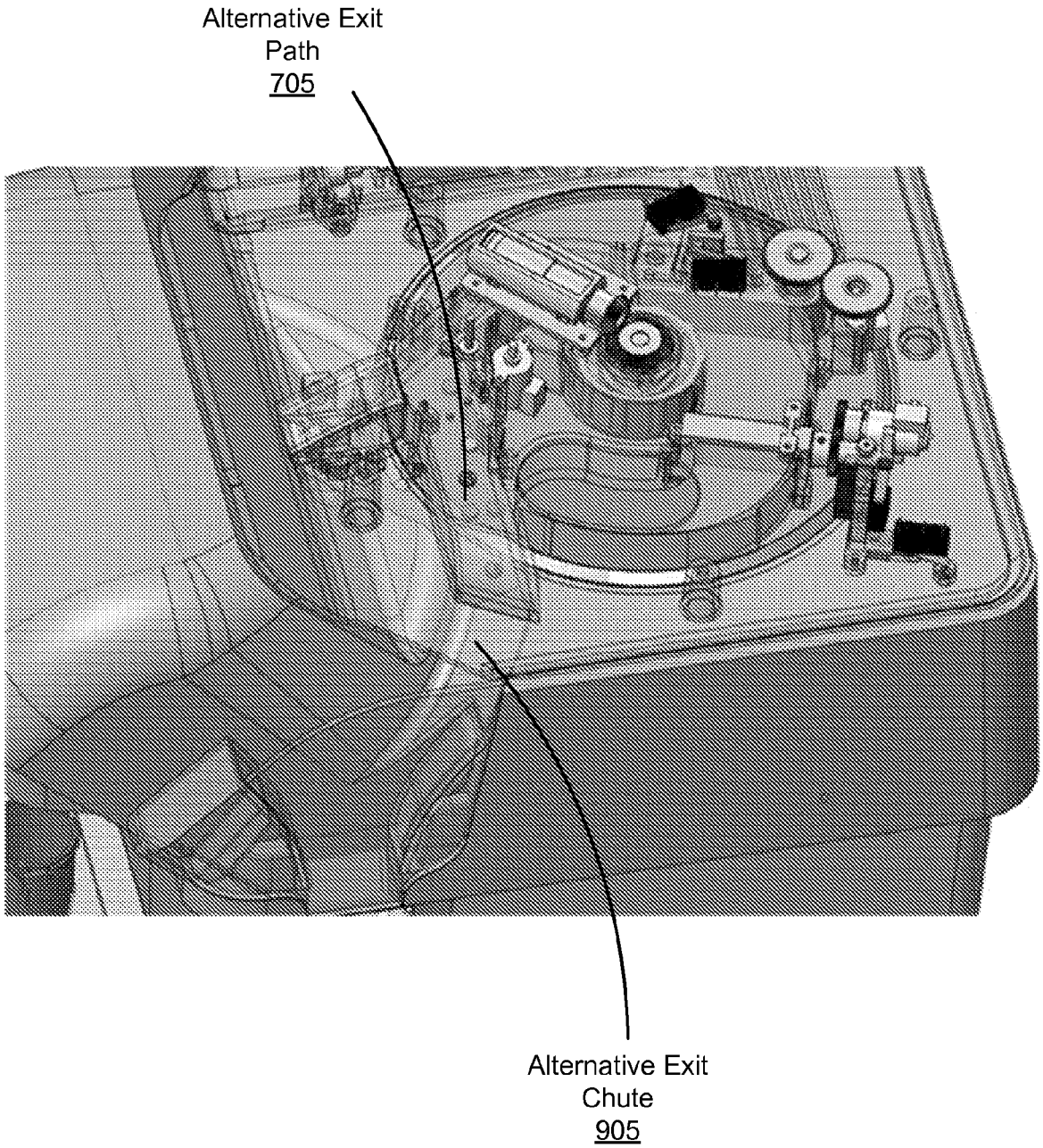
FIG. 9 shows pills on the rotating disk moving along the alternative exit path, according to one embodiment.

FIG. 9 shows pills on the rotating disk moving along the alternative exit path, according to one embodiment. As the pills leave the rotating disk 205 via the alternative exit path 805, the pills enter the alternative exit chute 905. In one embodiment, the edge of rotating disk 205 is perpendicular to the opening of the alternative exit chute 905 as described in conjunction with FIG. 5. In another embodiment the bottom edge of the alternative exit chute 905 is aligned with the surface of the rotating disk 205. In another embodiment, the edge of the rotating disk 205 tapers as it approaches the alternative exit chute 905, as described with respect to the exit path 240 in FIG. 5. In this embodiment the bottom edge of the alternative exit chute 905 is aligned with the surface of the rotating disk 205. The alternative exit chute 905 can be positioned closer or farther from exit chute 120, as desired, and can be otherwise shaped or angled to effectively move pills down the alternative exit chute 905.

Figure 10:
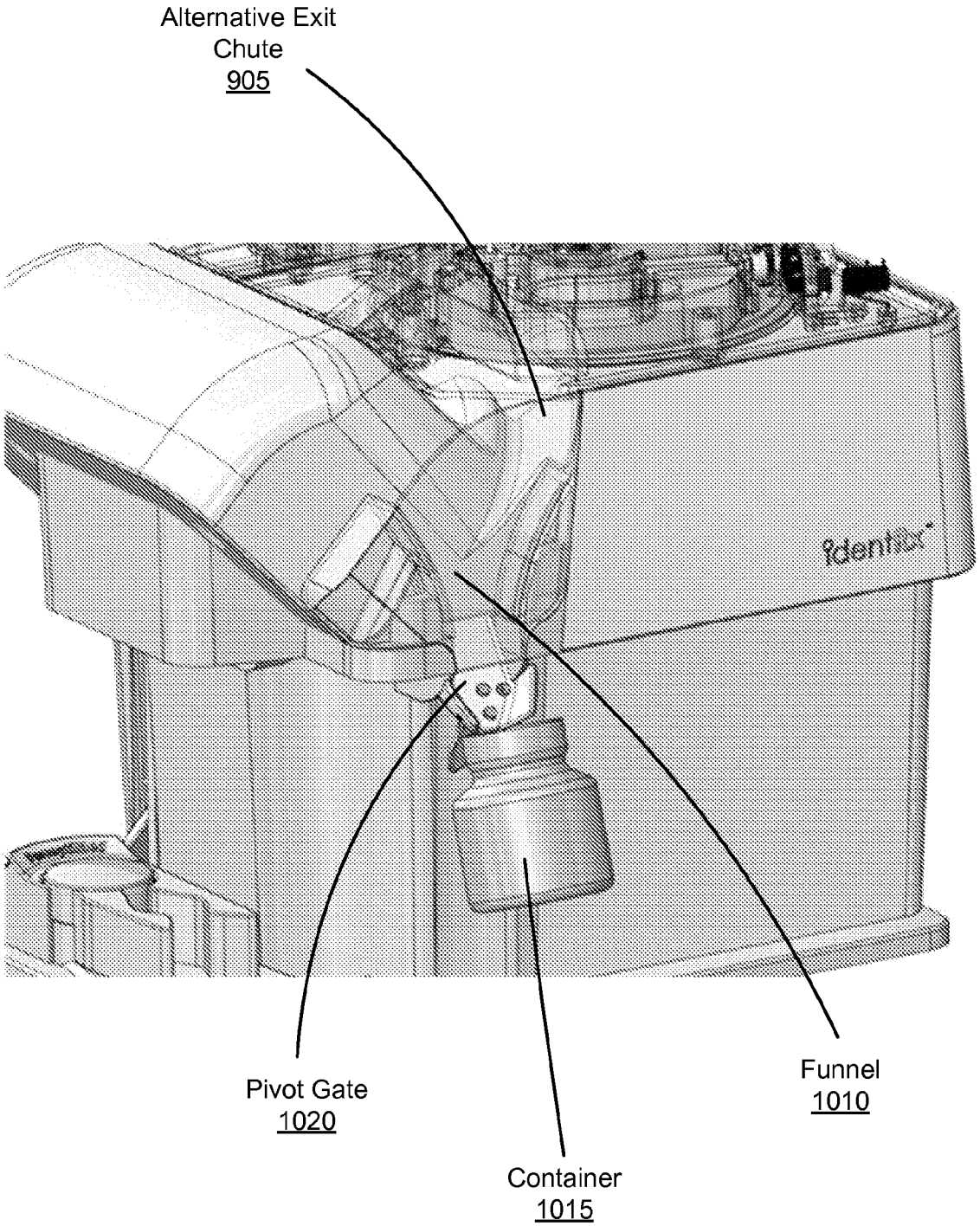
FIG. 10 shows a funnel connected to the alternative exit chute, according to one embodiment.

FIG. 10 shows a funnel connected to the alternative exit chute, according to one embodiment. In one embodiment, a funnel 1010 is connected to the end of the alternative exit chute 905. The funnel collects and holds pills that flow through the alternative exit chute 905. In one embodiment, a pivot gate 1020 rests at the end of the funnel 1010 preventing pills from exiting the funnel 1010. The funnel 1010 also releases pills into a container 1015 when the container 1015 is pressed against the shoulders of the pivoting gate 1020. For example, the user may use the original stock bottle from which pills were placed into the pill receiving area 105 as container 1015. In this example, excess pills present on the rotating disk 205 are returned to the stock bottle they were retrieved from via the alternate exit path 805 and the alternate exit chute 905. The alternative exit path 705 in conjunction with the exit chute 120 allows a user to add pills to the pill feeder 100 and allows the pill feeder to automatically send a desired number of pills to the exit chute 120 and return remaining pills to the container 1015 via the alternative exit chute 905, without leaving excess pills in the pill feeder 100.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention.

What is claimed is:

1. A pill feeder comprising:

a rotating disk including a receiving area for receiving a plurality of pills, the rotating disk configured to move the plurality of pills in a rotation direction about a surface of the rotating disk;

a lift gate located on the rotating disk in the rotation direction of the rotating disk relative to the receiving area, the lift gate configured to raise a height above the surface of the rotating disk that permits passage of a single layer of the plurality of pills;

a separator gate located on the rotating disk in the rotation direction of the rotating disk relative to the receiving area, the separator gate configured to open a width that permits passage of a single row of the plurality of pills; and an inner rail and an outer rail defining an exit path located on the rotating disk in the rotation direction of the rotating disk relative to the separator gate and the lift gate, wherein the inner rail intersects a rim of the rotating disk at an intersection point at a side of the inner rail between the inner rail and the outer rail and the inner rail has an exit path angle approaching the intersection point greater than 45degrees and less than 90 degrees, the exit path angle measured between a tangent of the rim at the intersection point and a tangent of the side of the inner rail at the intersection point.

2. The pill feeder of claim 1, further comprising:

an exit path sensor located on the exit path, the exit path sensor configured to determine an exit rate of pills as the pills pass through the exit path.

3. The pill feeder of claim 2, wherein a rotating speed of the rotating disk is adjusted to control the exit rate of the pills as the pills pass through the exit path.

4. The pill feeder of claim 1, further comprising a lift gate sensor that outputs a signal indicating detection of a pill passing under the lift gate; and wherein the height of the lift gate is based on the signal indicating detection of a pill passing under the lift gate.

5. The pill feeder of claim 4, wherein the lift gate sensor is configured to detect a jam at the opening of the lift gate based on the signal indicating detection of a pill.

6. The pill feeder of claim 1, further comprising a separator gate sensor that outputs a signal indicating detection of a pill passing the separator gate in the rotation direction; and wherein the width that the separator gate is opened to is based on the signal indicating detection of a pill passing the separator gate.

7. The pill feeder of claim 6, wherein the separator gate sensor is configured to detect a jam at the opening of the separator gate based on the signal indicating detection of a pill.

8. The pill feeder of claim 1, wherein a rate of rotation of the mixer, a direction of rotation of the mixer, or a combination thereof is based on at least on of: one or more sensors of the pill feeder detecting a jam at the separator gate or the lift gate, an attribute associated with a pill type of the plurality of pills, the height the lift gate is raised to, or the width to which the separator gate is opened.

9. The pill feeder of claim 8, wherein the attribute associated with the pill type is identified from a look-up table maintaining attributes for a plurality of pill types.

10. The pill feeder of claim 1, wherein the mixer rotation speed differs from the rotating disk rotation speed.

11. The pill feeder of claim 1, wherein the rotating disk is configured to reverse direction of motion when a jam is detected at the opening of the lift gate or the separator gate.

12. The pill feeder of claim 1, wherein the lift gate includes lift gate ridges.

13. The pill feeder of claim 1, wherein the pill feeder includes an exit chute coupled to the exit path at an angle of between 5 and 45 degrees.

14. The pill feeder of claim 13, wherein the exit chute is coupled to the exit path via a coupler.

15. The pill feeder of claim 1, further comprising:

an alternative exit path located on the rotating disk in the rotation direction of the rotating disk relative to the exit path, the alternative exit path including at least one exit path rail that guides the pill through the alternative exit path.

16. The pill feeder of claim 1, further comprising:

an alternative exit chute located on the rotating disk in the rotation direction of the rotating disk relative to the exit path.

17. The pill feeder of claim 16, further comprising:

a funnel attached to the alternative exit chute, the funnel configured to collect or dispense pills that travel through the alternative exit chute.

18. The pill feeder of claim 17, wherein the funnel includes a pivot gate that collects the pills that enter the funnel, and, responsive to a container pressed against the pivot gate to open the pivot gate, release the collected pills to the container.

19. The pill feeder of claim 1, wherein the lift gate is substantially shaped like a curved wedge.

20. The pill feeder of claim 1, wherein the separator gate includes a plow-like front face or a protruding wedge.

21. A feeder comprising:

a moving surface including a receiving area for receiving a plurality of objects, the moving surface configured to move the plurality of objects in a moving direction on the moving surface;

a lift gate located on the moving surface in the moving direction of the moving surface relative to the receiving area, the lift gate configured to raise a height above the moving surface that permits passage of a single layer of the plurality of objects;

a separator gate located on the moving surface in the moving direction of the moving surface relative to the receiving area, the separator gate configured to open a width that permits passage of a single row of the plurality of objects; and an inner rail and an outer rail defining an exit path located on the moving surface in the moving direction of the moving surface relative to the separator gate, wherein the inner rail intersects a periphery of the moving surface at an intersection point at a side of the inner rail between the inner rail and the outer rail and the inner rail has an exit path angle approaching the intersection point greater than 45 degrees and less than 90 degrees, the exit path angle measured between a tangent of the periphery at the intersection point and a tangent of the side of the inner rail at the intersection point.

22. The feeder of claim 21, wherein the moving surface comprises a rotating disk configured to move the plurality of objects in a rotation direction about a surface of the rotating disk.

23. The feeder of claim 22, further comprising:

a mixer that is configured to rotate in a direction opposite to that of the rotating disk.

24. The feeder of claim 23, wherein the mixer includes a cylindrical drum with a plurality of knobs on the surface of the drum.

25. The feeder of claim 23, wherein the mixer includes a cylindrical drum with a plurality of knobs in a threaded pitch extending from the bottom face of the mixer at an angle.

26. The feeder of claim 21, further comprising a lift gate sensor that outputs a signal indicating detection of an object passing under the lift gate; and wherein the height the lift gate is based on the signal indicating detection of an object passing under the lift gate.

27. The feeder of claim 21, further comprising a separator gate sensor that outputs a signal indicating detection of an object passing the separator gate in the rotation direction; and wherein the width the separator gate is opened to is based on the signal indicating detection of a pill passing the separator gate.

28. The feeder of claim 21, further comprising:

an alternative exit chute located on the moving surface in the moving direction of the moving surface relative to the exit path.

29. The feeder of claim 28, further comprising:

a funnel attached to the alternative exit chute, the funnel configured to collect or dispense pills that travel through the alternative exit chute.

30. The feeder of claim 29, wherein the funnel includes a pivot gate that collects the pills that enter the funnel, and, responsive to a container pressed against the pivot gate to open the pivot gate, release the collected pills to the container.

* * * * *